US007249016B2

(12) United States Patent
Chen et al.

(10) Patent No.: US 7,249,016 B2
(45) Date of Patent: Jul. 24, 2007

(54) QUANTIZATION MATRICES USING NORMALIZED-BLOCK PATTERN OF DIGITAL AUDIO

(75) Inventors: Wei-Ge Chen, Issaquah, WA (US); Naveen Thumpudi, Sammamish, WA (US); Ming-Chieh Lee, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 11 days.

(21) Appl. No.: 11/060,936

(22) Filed: Feb. 17, 2005

(65) Prior Publication Data

US 2005/0159947 A1 Jul. 21, 2005

Related U.S. Application Data

(62) Division of application No. 10/017,702, filed on Dec. 14, 2001, now Pat. No. 6,934,677.

(51) Int. Cl.
*G10L 19/02* (2006.01)

(52) U.S. Cl. ..... 704/223; 704/200.1; 704/500

(58) Field of Classification Search ..... None
See application file for complete search history.

(56) References Cited

U.S. PATENT DOCUMENTS 5,079,547 A 1/1992 Fuchigama et al.
5,260,980 A 11/1993 Akagiri et al.
5,388,181 A 2/1995 Anderson et al.
5,524,054 A 6/1996 Spille
5,627,938 A 5/1997 Johnston
5,629,780 A 5/1997 Watson
5,661,755 A 8/1997 Van De Kerkhof et al.
5,661,823 A 8/1997 Yamauchi et al.
5,682,152 A 10/1997 Wang et al.
5,684,920 A * 11/1997 Iwakami et al. ..... 704/203
5,686,964 A 11/1997 Tabatabai et al.

(Continued)

FOREIGN PATENT DOCUMENTS

EP 0597649 5/1994

(Continued)

OTHER PUBLICATIONS

Advanced Television Systems Committee, *ATSC Standard: Digital Audio Compression (AC-3), Revision A*, 140 pp. (1995).

(Continued)

*Primary Examiner*—Donald L. Storm
(74) *Attorney, Agent, or Firm*—Klarquist Sparkman, LLP

(57) ABSTRACT

Quantization matrices facilitate digital audio encoding and decoding. An audio encoder generates and compresses quantization matrices; an audio decoder decompresses and applies the quantization matrices. The invention includes several techniques and tools, which can be used in combination or separately. For example, the audio encoder can generate quantization matrices from critical band patterns for blocks of audio data. The encoder can compute the quantization matrices directly from the critical band patterns, which can be computed from the same audio data that is being compressed. The audio encoder/decoder can use different modes for generating/applying quantization matrices depending on the coding channel mode of multi-channel audio data. The audio encoder/decoder can use different compression/decompression modes for the quantization matrices, including a parametric compression/decompression mode.

20 Claims, 9 Drawing Sheets

U.S. PATENT DOCUMENTS

| | | | | |
|---|---|---|---|---|
| 5,701,346 | A | 12/1997 | Herre et al. | |
| 5,812,971 | A | 9/1998 | Herre | |
| 5,835,030 | A * | 11/1998 | Tsutsui et al. | 341/51 |
| 5,845,243 | A | 12/1998 | Smart et al. | |
| 5,956,674 | A | 9/1999 | Smyth et al. | |
| 5,974,380 | A | 10/1999 | Smyth et al. | |
| 5,995,151 | A | 11/1999 | Naveen et al. | |
| 6,029,126 | A | 2/2000 | Malvar | |
| 6,041,295 | A | 3/2000 | Hinderks | |
| 6,058,362 | A | 5/2000 | Malvar | |
| 6,064,954 | A * | 5/2000 | Cohen et al. | 704/207 |
| 6,115,688 | A | 9/2000 | Brandenburg et al. | |
| 6,115,689 | A | 9/2000 | Malvar | |
| 6,182,034 | B1 | 1/2001 | Malvar | |
| 6,240,380 | B1 | 5/2001 | Malvar | |
| 6,249,614 | B1 | 6/2001 | Kolesnik et al. | |
| 6,370,502 | B1 * | 4/2002 | Wu et al. | 704/230 |
| 6,445,739 | B1 | 9/2002 | Shen et al. | |
| 6,658,162 | B1 * | 12/2003 | Zeng et al. | 382/251 |
| 6,738,074 | B2 | 5/2004 | Rao et al. | |
| 6,766,293 | B1 | 7/2004 | Herre et al. | |
| 6,771,777 | B1 | 8/2004 | Gbur et al. | |
| 6,934,677 | B2 | 8/2005 | Chen et al. | |
| 2002/0143556 | A1 | 10/2002 | Kadatch | |
| 2004/0044527 | A1 | 3/2004 | Thumpudi et al. | |

FOREIGN PATENT DOCUMENTS

| | | |
|---|---|---|
| EP | 0669724 | 8/1995 |
| EP | 0910927 | 4/1999 |
| EP | 0931386 | 7/1999 |
| WO | W/O 99/43110 | 8/1999 |

OTHER PUBLICATIONS

Brandenburg, "ASPEC CODING", *AES 10th International Conference*, pp. 81-90 (1991).

"ISO/IEC 13818-7, Information Technology—Generic Coding of Moving Pictures and Associated Audio Information—Part 7: Advanced Audio Coding (AAC)," 152 pp. (1997).

"ISO/IEC 13818-7, Information Technology—Generic Coding of Moving Pictures and Associated Audio Information—Part 7: Advanced Audio Coding (AAC), Technical Corrigendum 1" 22 pp. (1998).

U.S. Appl. No. 09/771,371, filed Jan. 26, 2001, Kadatch.

U.S. Appl. No. 10/017,694, filed Dec. 14, 2001, Chen.

U.S. Appl. No. 10/017,861, filed Dec. 14, 2001, Chen.

U.S. Appl. No. 10/020,708, filed Dec. 14, 2001, Chen.

U.S. Appl. No. 10/016,918, filed Dec. 14, 2001, Chen.

Gibson et al., *Digital Compression for Multimedia*, Title Page, Contents, "Chapter 7: Frequency Domain Coding," Morgan Kaufman Publishers, Inc., pp. iii, v-xi, and 227-262 (1998).

H.S. Malvar, *Signal Processing with Lapped Transforms*, Artech House, Norwood, MA, pp. iv, vii-xi, 175-218, and 353-357 (1992).

H.S. Malvar, "Lapped Transforms for Efficient Transform/Subband Coding," *IEEE Transactions on Acoustics, Speech and Signal Processing*, vol. 38, No. 6, pp. 969-978 (1990).

Seymour Schlien, "The Modulated Lapped Transform, Its Time-Varying Forms, and Its Application to Audio Coding Standards," *IEEE Transactions on Speech and Audio Processing*, vol. 5, No. 4, pp. 359-366 (Jul. 1997).

de Queiroz et al., "Time-Varying Lapped Transforms and Wavelet Packets," *IEEE Transactions on Signal Processing*, vol. 41, pp. 3293-3305 (1993).

Herley et al., "Tilings of the Time-Frequency Plane: Construction of Arbitrary Orthogonal Bases and Fast Tiling Algorithms," *IEEE Transactions on Signal Processing*, vol. 41, No. 12, pp. 3341-3359 (1993).

ISO/IEC 11172-3, Information Technology—Coding of Moving Pictures and Associated Audio for Digital Storage Media at Up to About 1.5 Mbit/s—Part 3: Audio, 154 pp. (1993).

Dolby Laboratories, "AAC Technology," 4 pp. [Downloaded from the web site aac-audio.com on World Wide Web on Nov. 21, 2001.].

Srinivasan et al., "High-Quality Audio Compression Using an Adaptive Wavelet Packet Decomposition and Psychoacoustic Modeling," *IEEE Transactions on Signal Processing*, vol. 46, No. 4, pp. 1085-1093 (Apr. 1998).

Caetano et al., "Rate Control Strategy for Embedded Wavelet Video Coders," *Electronics Letters*, pp. 1815-1817 (Oct. 14, 1999).

Ribas Corbera et al., "Rate Control in DCT Video Coding for Low-Delay Communications," *IEEE Transactions on Circuits and Systems for Video Technology*, vol. 9, No. 1, pp. 172-185 (Feb. 1999).

Zwicker et al., *Das Ohr als Nachrichtenempfänger*, Title Page, Table of Contents, "I: Schallschwingungen," Index, Hirzel-Verlag, Stuttgart, pp. III, IX-XI, 1-26, and 231-232 (1967).

Terhardt, "Calculating Virtual Pitch," *Hearing Research*, 1:155-182 (1979).

Lufti, "Additivity of Simultaneous Masking," *Journal of Acoustic Society of America*, 73:262-267 (1983).

Jesteadt et al., "Forward Masking as a Function of Frequency, Masker Level, and Signal Delay," *Journal of Acoustical Society of America*, 71:950-962 (1982).

ITU, Recommendation ITU-R BS 1387, Method for Objective Measurements of Perceived Audio Quality, 89 pp. (1998).

ITU, Recommendation ITU-R BS 1115, Low Bit-Rate Audio Coding, 9 pp. (1994).

Beerends, "Audio Quality Determination Based on Perceptual Measurement Techniques," *Applications of Digital Signal Processing to Audio and Acoustics*, Chapter 1, Ed. Mark Kahrs, Karlheinz Bradenburg, Kluwer Acad. Publ., pp. 1-38 (1998).

Zwicker, *Psychoakustik*, Title Page, Table of Contents, "Teil I: Einfuhrung," Index, Springer-Verlag, Berlin Heidelberg, New York, pp. II, IX-XI, 1-30, and 157-162 (1982).

Solari, *Digital Video and Audio Compression*, Title Page, Contents, "Chapter 8: Sound and Audio," McGraw-Hill, Inc., pp. iii, v-vi, and 187-211 (1997).

A.M. Kondoz, *Digital Speech: Coding for Low Bit Rate Communications Systems*, "Chapter 3.3: Linear Predictive Modeling of Speech Signals" and "Chapter 4: LPC Parameter Quantisation Using LSFs," John Wiley & Sons, pp. 42-53 and 79-97 (1994).

Wragg et al., "An Optimised Software Solution for an ARM Powered™ MP3 Decoder," 9 pp. [Downloaded from the World Wide Web on Oct. 27, 2001.].

Fraunhofer-Gesellschaft, "MPEG Audio Layer-3," 4 pp. [Downloaded from the World Wide Web on Oct. 24, 2001.].

Fraunhofer-Gesellschaft, "MPEG-2 AAC," 3 pp. [Downloaded from the World Wide Web on Oct. 24, 2001.].

OPTICOM GmbH, "Objective Perceptual Measurement," 14 pp. [Downloaded from the World Wide Web on Oct. 24, 2001.].

De Luca, "AN1090 Application Note: STA013 MPEG 2.5 Layer III Source Decoder," STMicroelectronics, 17 pp. (1999).

Phamdo, "Speech Compression," 13 pp. [Downloaded from the World Wide Web on Nov. 25, 2001.].

Malvar, "Biorthogonal and Nonuniform Lapped Transforms for Transform Coding with Reduced Blocking and Ringing Artifacts," appeared in *IEEE Transactions on Signal Processing, Special Issue on Multirate Systems, Filter Banks, Wavelets, and Applications*, vol. 46, 29 pp. (1998).

Bosi et al., "ISO/IEC MPEG-2 Advanced Audio Coding," Journal of the Audio Engineering Society, Audio Engineering Society, vol. 45, No. 10, pp. 789-812 (1997).

Davis, "The AC-3 Multichannel Coder," Dolby Laboratories, 9 pp. (Downloaded from the World Wide Web on Aug. 15, 2002).

Edler et al., "Perceptual Audio Coding Using a Time-Varying Linear Pre- and Post-Filter," in AES 109th Convention, Los Angeles, California, 12 pp. (Sep. 2000).

ISO/IEC 13818-7, Information technology—Generic coding of moving pictures and associated audio information—Part 7: Advanced Audio Coding (AAC), 150 pp. (1997).

Kuo et al., "A Study of Why Cross Channel Prediction is Not Applicable to Perceptual Audio Coding," IEEE Signal Processing Letters, vol. 8, No. 9, 3 pp. (Sep. 2001).

Meares, D.J., "Matrixed Surround Sound in an MPEG Digital World," Journal of the Audio Engineering Society, vol. 46, No. 4, 13 pp. (Apr. 1998).
"MPEG2 Audio for DVD: the Compromise Choice," 5 pp. (Oct. 1996).
Search Report for European Patent Application No. 03 020 110.7, Mar. 28, 2006.
Search Report for European Patent Application No. 03 020 111.5, Mar. 28, 2006.
Stuart et al., "Lossless Compression for DVD-Audio," in AES 9th Regional Convention Tokyo, 4 pp. (1999).
Vaidyanathan, Multirate Systems and Filter Banks, Prentice Hall Signal Processing Series, Cover page, pp. 745-751 (1992).
Van Assche et al., "Lossless Compression of Pre-Press Image Using a Novel Color Decorrelation Technique," Proc. SPIE, Very High Resolution and Quality III. vol. 3308, 8 pp. (1998).
Wang et al., "A Multichannel Audio Coding Algorithm for Inter-Channel Redundancy Removal," in AES 110th Convention, Amsterdam, the Netherlands, 6pp. (May 2001).
Wang et al., "EE225a Lecture 13: Karhunen Loève Transform and Discrete Cosine Transform," Department of EECS, University of California at Berkley, 10 pp. (Mar. 2002).
Yang et al., "Adaptive Karhunen-Loeve Transform for Enhanced Multichannel Audio Coding," Proc. SPIE vol. 4475, 13 pp., Mathematics of Data/Image Coding, Compression, and Encryption IV San Diego, CA. (Jul. 29-Aug. 3, 2001).
Yang et al., "An Inter-Channel Redundancy Removal Approach for High-Quality Multichannel Audio Compression," in AES 109th Convention, Los Angeles, California, 8 pp. (Sep. 2000).

* cited by examiner

Figure 1, Prior Art
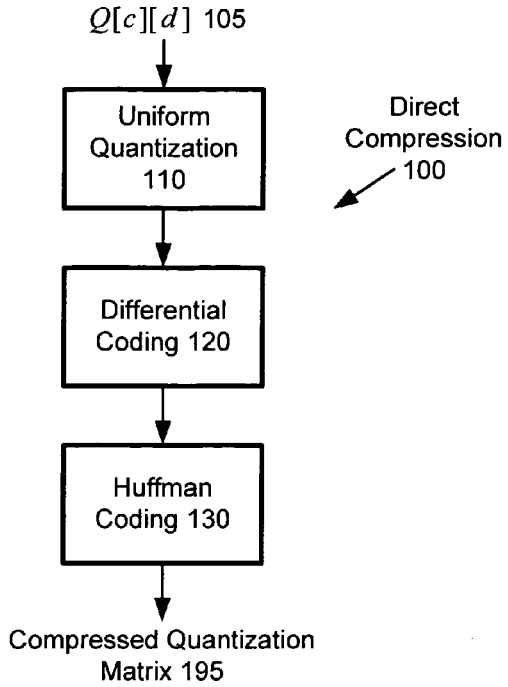
Figure 2
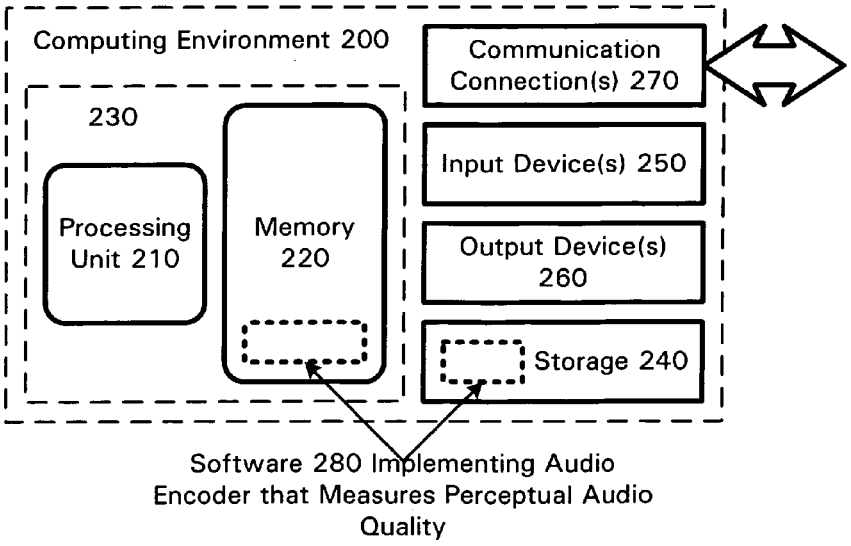

QUANTIZATION MATRICES USING NORMALIZED-BLOCK PATTERN OF DIGITAL AUDIO

RELATED APPLICATION INFORMATION

The present application is a divisional of U.S. patent application Ser. No. 10/017,702, filed Dec. 14, 2001, now U.S. Pat. No. 6,934,677, entitled, "Quantization Matrices Based on Critical Band Information For Digital Audio wherein Qoantization Bands Differ from Critical Bands," the disclosure of which is hereby incorporated by reference. The following U.S. patent applications relate to the present application: 1) U.S. patent application Ser. No. 10/020,708, entitled, "Adaptive Window-Size Selection in Transform Coding," filed Dec. 14, 2001, the disclosure of which is hereby incorporated by reference; 2) U.S. patent application Ser. No. 10/016,918, entitled, "Quality Improvement Techniques in an Audio Encoder," filed Dec. 14, 2001, the disclosure of which is hereby incorporated by reference; 3) U.S. Patent application Ser. No. 10/017,694, now U.S. Pat. No. 7,027,982, entitled, "Quality and Rate Control Strategy for Digital Audio," filed Dec. 14, 2001, the disclosure of which is hereby incorporated by reference; and 4) U.S. patent application Ser. No. 10/017,861 now U.S. Pat. No. 7,146,313, entitled, "Techniques for Measurement of Perceptual Audio Quality," filed Dec. 14, 2001, the disclosure of which is hereby incorporated by reference.

TECHNICAL FIELD

The present invention relates to quantization matrices for audio encoding and decoding. In one embodiment, an audio encoder generates and compresses quantization matrices, and an audio decoder decompresses and applies the quantization matrices.

BACKGROUND

With the introduction of compact disks, digital wireless telephone networks, and audio delivery over the Internet, digital audio has become commonplace. Engineers use a variety of techniques to process digital audio efficiently while still maintaining the quality of the digital audio. To understand these techniques, it helps to understand how audio information is represented in a computer and how humans perceive audio.

I. Representation of Audio Information in a Computer

A computer processes audio information as a series of numbers representing the audio information. For example, a single number can represent an audio sample, which is an amplitude value (i.e., loudness) at a particular time. Several factors affect the quality of the audio information, including sample depth, sampling rate, and channel mode.

Sample depth (or precision) indicates the range of numbers used to represent a sample. The more values possible for the sample, the higher the quality because the number can capture more subtle variations in amplitude. For example, an 8-bit sample has 256 possible values, while a 16-bit sample has 65,536 possible values.

The sampling rate (usually measured as the number of samples per second) also affects quality. The higher the sampling rate, the higher the quality because more frequencies of sound can be represented. Some common sampling rates are 8,000, 11,025, 22,050, 32,000, 44,100, 48,000, and 96,000 samples/second.

Mono and stereo are two common channel modes for audio. In mono mode, audio information is present in one channel. In stereo mode, audio information is present in two channels usually labeled the left and right channels. Other modes with more channels, such as 5-channel surround sound, are also possible. Table 1 shows several formats of audio with different quality levels, along with corresponding raw bitrate costs.

TABLE 1

Bitrates for different quality audio information

| Quality | Sample Depth (bits/sample) | Sampling Rate (samples/second) | Mode | Raw Bitrate (bits/second) |
|---|---|---|---|---|
| Internet telephony | 8 | 8,000 | mono | 64,000 |
| Telephone | 8 | 11,025 | mono | 88,200 |
| CD audio | 16 | 44,100 | stereo | 1,411,200 |
| high quality audio | 16 | 48,000 | stereo | 1,536,000 |

As Table 1 shows, the cost of high quality audio information such as CD audio is high bitrate. High quality audio information consumes large amounts of computer storage and transmission capacity.

Compression (also called encoding or coding) decreases the cost of storing and transmitting audio information by converting the information into a lower bitrate form. Compression can be lossless (in which quality does not suffer) or lossy (in which quality suffers). Decompression (also called decoding) extracts a reconstructed version of the original information from the compressed form.

Quantization is a conventional lossy compression technique. There are many different kinds of quantization including uniform and non-uniform quantization, scalar and vector quantization, and adaptive and non-adaptive quantization. Quantization maps ranges of input values to single values. For example, with uniform, scalar quantization by a factor of 3.0, a sample with a value anywhere between −1.5 and 1.499 is mapped to 0, a sample with a value anywhere between 1.5 and 4.499 is mapped to 1, etc. To reconstruct the sample, the quantized value is multiplied by the quantization factor, but the reconstruction is imprecise. Continuing the example started above, the quantized value 1 reconstructs to $1\times3=3$; it is impossible to determine where the original sample value was in the range 1.5 to 4.499. Quantization causes a loss in fidelity of the reconstructed value compared to the original value. Quantization can dramatically improves the effectiveness of subsequent lossless compression, however, thereby reducing bitrate.

An audio encoder can use various techniques to provide the best possible quality for a given bitrate, including transform coding, rate control, and modeling human perception of audio. As a result of these techniques, an audio signal can be more heavily quantized at selected frequencies or times to decrease bitrate, yet the increased quantization will not significantly degrade perceived quality for a listener.

Transform coding techniques convert data into a form that makes it easier to separate perceptually important information from perceptually unimportant information. The less important information can then be quantized heavily, while the more important information is preserved, so as to provide the best perceived quality for a given bitrate. Transform coding techniques typically convert data into the frequency (or spectral) domain. For example, a transform coder converts a time series of audio samples into frequency coefficients. Transform coding techniques include Discrete Cosine Transform ["DCT"], Modulated Lapped Transform ["MLT"], and Fast Fourier Transform ["FFT"]. In practice, the input to a transform coder is partitioned into blocks, and each block is transform coded. Blocks may have varying or fixed sizes, and may or may not overlap with an adjacent block. For more information about transform coding and MLT in particular, see Gibson et al., *Digital Compression for Multimedia*, "Chapter 7: Frequency Domain Coding," Morgan Kaufman Publishers, Inc., pp. 227-262 (1998); U.S. Pat. No. 6,115,689 to Malvar; H. S. Malvar, *Signal Processing with Lapped Transforms*, Artech House, Norwood, Mass., 1992; or Seymour Schlein, "The Modulated Lapped Transform, Its Time-Varying Forms, and Its Application to Audio Coding Standards," IEEE Transactions on Speech and Audio Processing, Vol. 5, No. 4, pp. 359-66, July 1997.

With rate control, an encoder adjusts quantization to regulate bitrate. For audio information at a constant quality, complex information typically has a higher bitrate (is less compressible) than simple information. So, if the complexity of audio information changes in a signal, the bitrate may change. In addition, changes in transmission capacity (such as those due to Internet traffic) affect available bitrate in some applications. The encoder can decrease bitrate by increasing quantization, and vice versa. Because the relation between degree of quantization and bitrate is complex and hard to predict in advance, the encoder can try different degrees of quantization to get the best quality possible for some bitrate, which is an example of a quantization loop.

II. Human Perception of Audio Information

In addition to the factors that determine objective audio quality, perceived audio quality also depends on how the human body processes audio information. For this reason, audio processing tools often process audio information according to an auditory model of human perception.

Typically, an auditory model considers the range of human hearing and critical bands. Humans can hear sounds ranging from roughly 20 Hz to 20 kHz, and are most sensitive to sounds in the 2-4 kHz range. The human nervous system integrates sub-ranges of frequencies. For this reason, an auditory model may organize and process audio information by critical bands. For example, one critical band scale groups frequencies into 24 critical bands with upper cut-off frequencies (in Hz) at 100, 200, 300, 400, 510, 630, 770, 920, 1080, 1270, 1480, 1720, 2000, 2320, 2700, 3150, 3700, 4400, 5300, 6400, 7700, 9500, 12000, and 15500. Different auditory models use a different number of critical bands (e.g., 25, 32, 55, or 109) and/or different cut-off frequencies for the critical bands. Bark bands are a well-known example of critical bands.

Aside from range and critical bands, interactions between audio signals can dramatically affect perception. An audio signal that is clearly audible if presented alone can be completely inaudible in the presence of another audio signal, called the masker or the masking signal. The human ear is relatively insensitive to distortion or other loss in fidelity (i.e., noise) in the masked signal, so the masked signal can include more distortion without degrading perceived audio quality. Table 2 lists various factors and how the factors relate to perception of an audio signal.

TABLE 2

Various factors that relate to perception of audio

| Factor | Relation to Perception of an Audio Signal |
|---|---|
| outer and middle ear transfer | Generally, the outer and middle ear attenuate higher frequency information and pass middle frequency information. Noise is less audible in higher frequencies than middle frequencies. |
| noise in the auditory nerve | Noise present in the auditory nerve, together with noise from the flow of blood, increases for low frequency information. Noise is less audible in lower frequencies than middle frequencies. |
| perceptual frequency scales | Depending on the frequency of the audio signal, hair cells at different positions in the inner ear react, which affects the pitch that a human perceives. Critical bands relate frequency to pitch. |
| excitation | Hair cells typically respond several milliseconds after the onset of the audio signal at a frequency. After exposure, hair cells and neural processes need time to recover full sensitivity. Moreover, loud signals are processed faster than quiet signals. Noise can be masked when the ear will not sense it. |
| detection | Humans are better at detecting changes in loudness for quieter signals than louder signals. Noise can be masked in louder signals. |
| simultaneous masking | For a masker and maskee present at the same time, the maskee is masked at the frequency of the masker but also at frequencies above and below the masker. The amount of masking depends on the masker and maskee structures and the masker frequency. |
| temporal masking | The masker has a masking effect before and after than the masker itself. Generally, forward masking is more pronounced than backward masking. The masking effect diminishes further away from the masker in time. |
| loudness | Perceived loudness of a signal depends on frequency, duration, and sound pressure level. The components of a signal partially mask each other, and noise can be masked as a result. |
| cognitive processing | Cognitive effects influence perceptual audio quality. Abrupt changes in quality are objectionable. Different components of an audio signal are important in different applications (e.g., speech vs. music). |

An auditory model can consider any of the factors shown in Table 2 as well as other factors relating to physical or neural aspects of human perception of sound. For more information about auditory models, see:

1) Zwicker and Feldtkeller, "Das Ohr als Nachrichtenempfänger," Hirzel-Verlag, Stuttgart, 1967;
2) Terhardt, "Calculating Virtual Pitch," Hearing Research, 1:155-182, 1979;
3) Lufti, "Additivity of Simultaneous Masking," Journal of Acoustic Society of America, 73:262 267, 1983;
4) Jesteadt et al., "Forward Masking as a Function of Frequency, Masker Level, and Signal Delay," Journal of Acoustical Society of America, 71:950-962, 1982;
5) ITU, Recommendation ITU-R BS 1387, Method for Objective Measurements of Perceived Audio Quality, 1998;
6) Beerends, "Audio Quality Determination Based on Perceptual Measurement Techniques," *Applications of Digital Signal Processing to Audio and Acoustics*, Chapter 1, Ed. Mark Kahrs, Karlheinz Brandenburg, Kluwer Acad. Publ., 1998; and
7) Zwicker, *Psychoakustik*, Springer-Verlag, Berlin Heidelberg, New York, 1982.

III. Generating Quantization Matrices

Quantization and other lossy compression techniques introduce potentially audible noise into an audio signal. The audibility of the noise depends on 1) how much noise there is and 2) how much of the noise the listener perceives. The first factor relates mainly to objective quality, while the second factor depends on human perception of sound.

Distortion is one measure of how much noise is in reconstructed audio. Distortion D can be calculated as the square of the differences between original values and reconstructed values:

$$D=(u-q(u)Q)^2 \quad (1),$$

where u is an original value, q(u) is a quantized value, and Q is a quantization factor. The distribution of noise in the reconstructed audio depends on the quantization scheme used in the encoder.

For example, if an audio encoder uses uniform, scalar quantization for each frequency coefficient of spectral audio data, noise is spread equally across the frequency spectrum of the reconstructed audio, and different levels are quantized at the same accuracy. Uniform, scalar quantization is relatively simple computationally, but can result in the complete loss of small values at moderate levels of quantization. Uniform, scalar quantization also fails to account for the varying sensitivity of the human ear to noise at different frequencies and levels of loudness, interaction with other sounds present in the signal (i.e., masking), or the physical limitations of the human ear (i.e., the need to recover sensitivity).

Power-law quantization (e.g., $\alpha$-law) is a non-uniform quantization technique that varies quantization step size as a function of amplitude. Low levels are quantized with greater accuracy than high levels, which tends to preserve low levels along with high levels. Power-law quantization still fails to fully account for the audibility of noise, however.

Another non-uniform quantization technique uses quantization matrices. A quantization matrix is a set of weighting factors for series of values called quantization bands. Each value within a quantization band is weighted by the same weighting factor. A quantization matrix spreads distortion in unequal proportions, depending on the weighting factors. For example, if quantization bands are frequency ranges of frequency coefficients, a quantization matrix can spread distortion across the spectrum of reconstructed audio data in unequal proportions. Some parts of the spectrum can have more severe quantization and hence more distortion; other parts can have less quantization and hence less distortion.

Microsoft Corporation's Windows Media Audio version 7.0 ["WMA7"] generates quantization matrices for blocks of frequency coefficient data. In WMA7, an audio encoder uses a MLT to transform audio samples into frequency coefficients in variable-size transform blocks. For stereo mode audio data, the encoder can code left and right channels into sum and difference channels. The sum channel is the averages of the left and right channels; the difference channel is the differences between the left and right channels divided by two. The encoder computes a quantization matrix for each channel:

$$Q[c][d]=E[d] \quad (2),$$

where c is a channel, d is a quantization band, and E[d] is an excitation pattern for the quantization band d. The WMA7 encoder calculates an excitation pattern for a quantization band by squaring coefficient values to determine energies and then summing the energies of the coefficients within the quantization band.

Since the quantization bands can have different sizes, the encoder adjusts the quantization matrix Q[c][d] by the quantization band sizes:

$$Q[c][d] \leftarrow \left(\frac{Q[c][d]}{Card\{B[d]\}}\right)^u, \quad (3)$$

where Card {B[d]} is the number of coefficients in the quantization band d, and where u is an experimentally derived exponent (in listening tests) that affects relative weights of bands of different energies. For stereo mode audio data, whether the data is in independently (i.e., left and right) or jointly (i.e., sum and difference) coded channels, the WMA7 encoder uses the same technique to generate quantization matrices for two individual coded channels.

The quantization matrices in WMA7 spread distortion between bands in proportion to the energies of the bands. Higher energy leads to a higher weight and more quantization; lower energy leads to a lower weight and less quantization. WMA7 still fails to account for the audibility of noise in several respects, however, including the varying sensitivity of the human ear to noise at different frequencies and times, temporal masking, and the physical limitations of the human ear.

In order to reconstruct audio data, a WMA7 decoder needs the quantization matrices used to compress the audio data. For this reason, the WMA7 encoder sends the quantization matrices to the decoder as side information in the bitstream of compressed output. To reduce bitrate, the encoder compresses the quantization matrices using a technique such as the direct compression technique (100) shown in FIG. 1.

In the direct compression technique (100), the encoder uniformly quantizes (110) each element of a quantization matrix (105). The encoder then differentially codes (120) the quantized elements, and Huffman codes (130) the differentially coded elements. The technique (100) is computationally simple and effective, but the resulting bitrate for the quantization matrix is not low enough for very low bitrate coding.

Aside from WMA7, several international standards describe audio encoders that spread distortion in unequal proportions across bands. The Motion Picture Experts Group, Audio Layer 3 ["MP3]" and Motion Picture Experts Group 2, Advanced Audio Coding ["MC"] standards each describe scale factors used when quantizing spectral audio data.

In MP3, the scale factors are weights for ranges of frequency coefficients called scale factor bands. Each scale factor starts with a minimum weight for a scale factor band. The number of scale factor bands depends on sampling rate and block size (e.g., 21 scale factor bands for a long block of 48 kHz input). For the starting set of scale factors; the encoder finds a satisfactory quantization step size in an inner quantization loop. In an outer quantization loop, the encoder amplifies the scale factors until the distortion in each scale factor band is less than the allowed distortion threshold for that scale factor band, with the encoder repeating the inner quantization loop for each adjusted set of scale factors. In special cases, the encoder exits the outer quantization loop even if distortion exceeds the allowed distortion threshold for a scale factor band (e.g., if all scale factors have been amplified or if a scale factor has reached a maximum amplification). The MP3 encoder transmits the scale factors as side information using ad hoc differential coding and, potentially, entropy coding.

Before the quantization loops, the MP3 encoder can switch between long blocks of 576 frequency coefficients and short blocks of 192 frequency coefficients (sometimes called long windows or short windows). Instead of a long block, the encoder can use three short blocks for better time resolution. The number of scale factor bands is different for short blocks and long blocks (e.g., 12 scale factor bands vs. 21 scale factor bands).

The MP3 encoder can use any of several different coding channel modes, including single channel, two independent channels (left and right channels), or two jointly coded channels (sum and difference channels). If the encoder uses jointly coded channels, the encoder computes and transmits a set of scale factors for each of the sum and difference channels using the same techniques that are used for left and right channels. Or, if the encoder uses jointly coded channels, the encoder can instead use intensity stereo coding. Intensity stereo coding changes how scale factors are determined for higher frequency scale factor bands and changes how sum and difference channels are reconstructed, but the encoder still computes and transmits two sets of scale factors for the two channels.

The MP3 encoder incorporates a psychoacoustic model when determining the allowed distortion thresholds for scale factor bands. In a path separate from the rest of the encoder, the encoder processes the original audio data according to the psychoacoustic model. The psychoacoustic model uses a different frequency transform than the rest of the encoder (FFT vs. hybrid polyphase/MDCT filter bank) and uses separate computations for energy and other parameters; In the psychoacoustic model, the MP3 encoder processes the blocks of frequency coefficients according to threshold calculation partitions at sub-Bark band resolution (e.g., 62 partitions for a long block of 48 kHz input). The encoder calculates a Signal to Mask Ratio ["SMR"] for each partition, and then converts the SMRs for the partitions into SMRs for the scale factor bands. The MP3 encoder later converts the SMRs for scale factor bands into the allowed distortion thresholds for the scale factor bands. The encoder runs the psychoacoustic model twice (in parallel, once for long blocks and once for short blocks) using different techniques to calculate SMR depending on the block size.

For additional information about MP3 and MC, see the MP3 standard ("ISO/IEC 11172-3, Information Technology—Coding of Moving Pictures and Associated Audio for Digital Storage Media at Up to About 1.5 Mbit/s—Part 3: Audio") and the AAC standard.

Although MP3 encoding has achieved widespread adoption, it is unsuitable for some applications (for example, real-time audio streaming at very low to mid bitrates) for several reasons. First, MP3's iterative refinement of scale factors in the outer quantization loop consumes too many resources for some applications. Repeated iterations of the outer quantization loop consume time and computational resources. On the other hand, if the outer quantization loop exits quickly (i.e., with minimum scale factors and a small quantization step size), the MP3 encoder can waste bitrate encoding audio information with distortion well below the allowed distortion thresholds. Second, computing SMR with a psychoacoustic model separate from the rest of the MP3 encoder (e.g., separate frequency transform, computations of energy, etc.) consumes too much time and computational resources for some applications. Third, computing SMRs in parallel for long blocks as well as short blocks consumes more resources than is necessary when the encoder switches between long blocks or short blocks in the alternative. Computing SMRs in separate tracks also does not allow direct comparisons between blocks of different sizes for operations like temporal spreading. Fourth, the MP3 encoder does not adequately exploit differences between independently coded channels and jointly coded channels when computing and transmitting quantization matrices. Fifth, ad hoc differential coding and entropy coding of scale factors in MP3 gives good quality for the scale factors, but the bitrate for the scale factors is not low enough for very low bitrate applications.

IV. Parametric Coding of Audio Information

Parametric coding is an alternative to transform coding, quantization., and lossless compression in applications such as speech compression. With parametric coding, an encoder converts a block of audio samples into a set of parameters describing the block (rather than coded versions of the audio samples themselves). A decoder later synthesizes the block of audio samples from the set of parameters. Both the bitrate and the quality for parametric coding are typically lower than other compression methods.

One technique for parametrically compressing a block of audio samples uses Linear Predictive Coding ["LPC"] parameters and Line-Spectral Frequency ["LSF"] values. First, the audio encoder computes the LPC parameters. For example, the audio encoder computes autocorrelation values for the block of audio samples itself, which are short-term correlations between samples within the block. From the autocorrelation values, the encoder computes the LPC parameters using a technique such as Levinson recursion. Other techniques for determining LPC parameters use a covariance method or a lattice method.

Next, the encoder converts the LPC parameters to LSF values, which capture spectral information for the block of audio samples. LSF values have greater intra-block and inter-block correlation than LPC parameters, and are better suited for subsequent quantization. For example, the encoder computes partial correlation ["PARCOR"] or reflection coefficients from the LPC parameters. The encoder then computes the LSF values from the PARCOR coefficients using a method such as complex root, real root, ratio filter, Chebyshev, or adaptive sequential LMS. Finally, the encoder quantizes the LSF values. Instead of LSF values, different techniques convert LPC parameters to a log area ratio, inverse sine, or other representation. For more information about parametric coding, LPC parameters, and LSF values, see A. M. Kondoz, *Digital Speech: Coding for Low Bit Rate Communications Systems*, "Chapter 3.3: Linear Predictive Modeling of Speech Signals" and "Chapter 4: LPC Parameter Quantisation Using LSFs," John Wiley & Sons (1994).

WMA7 allows a parametric coding mode in which the audio encoder parametrically codes the spectral shape of a block of audio samples. The resulting parameters represent the quantization matrix for the block, rather than the more conventional application of representing the audio signal itself. The parameters used in WMA7 represent spectral shape of the audio block, but do not adequately account for human perception of audio information.

SUMMARY

The present invention relates to quantization matrices for audio encoding and decoding. The present invention includes various techniques and tools relating to quantization matrices, which can be used in combination or independently.

First, an audio encoder generates quantization matrices based upon critical band patterns for blocks of audio data. The encoder computes the critical band patterns using an auditory model, so the quantization matrices account for the audibility of noise in quantization of the audio data. The encoder computes the quantization matrices directly from the critical band patterns, which reduces computational overhead in the encoder and limits bitrate spent coding perceptually unimportant information.

Second, an audio encoder generates quantization matrices from critical band patterns computed using an auditory model, processing the same frequency coefficients in the auditory model that the encoder compresses. This reduces computational overhead in the encoder.

Third, blocks of data having variable size are normalized before generating quantization matrices for the blocks. The normalization improves auditory modeling by enabling temporal smearing.

Fourth, an audio encoder uses different modes for generating quantization matrices depending on the coding channel mode for multi-channel audio data, and an audio decoder can use different modes when applying the quantization matrices. For example, for stereo mode audio data in jointly coded channels, the encoder generates an identical quantization matrix for sum and difference channels, which can reduce the bitrate associated with quantization matrices for the sum and difference channels and simplify generation of quantization matrices.

Fifth, an audio encoder uses different modes for compressing quantization matrices, including a parametric compression mode. An audio decoder uses different modes for decompressing quantization matrices, including a parametric compression mode. The parametric compression mode lowers bitrate for quantization matrices enough for very low bitrate applications while also accounting for human perception of audio information.

Additional features and advantages of the invention will be made apparent from the following detailed description of an illustrative embodiment that proceeds with reference to the accompanying drawings.

BRIEF DESCRIPTION OF THE DRAWINGS

FIG. 1 is a diagram showing direct compression of a quantization matrix according to the prior art.

FIG. 2 is a block diagram of a suitable computing environment in which the illustrative embodiment may be implemented.

DETAILED DESCRIPTION

Figure 3:
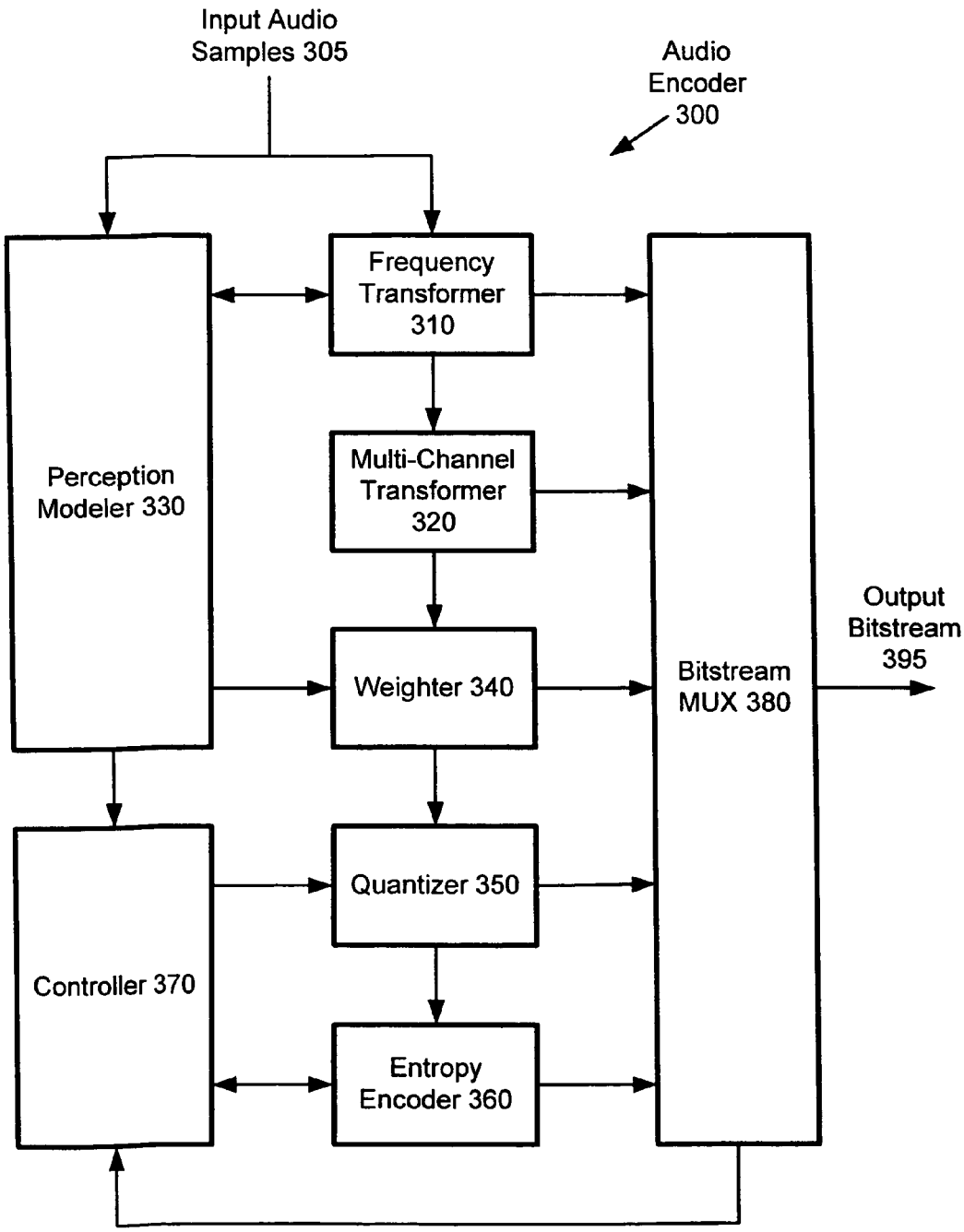
FIG. 3 is a block diagram of a generalized audio encoder according to the illustrative embodiment.

The illustrative embodiment of the present invention is directed to generation/application and compression/decompression of quantization matrices for audio encoding/decoding.

An audio encoder balances efficiency and quality when generating quantization matrices. The audio encoder computes quantization matrices directly from excitation patterns for blocks of frequency coefficients, which makes the computation efficient and controls bitrate. At the same time, to generate the excitation patterns, the audio encoder processes the blocks of frequency coefficients by critical bands according to an auditory model, so the quantization matrices account for the audibility of noise.

For audio data in jointly coded channels, the audio encoder directly controls distortion and reduces computations when generating quantization matrices, and can reduce the bitrate associated with quantization matrices at little or no cost to quality. The audio encoder computes a single quantization matrix for sum and difference channels of jointly coded stereo data from aggregated excitation patterns for the individual channels. In some implementations, the encoder halves the bitrate associated with quantization matrices for audio data in jointly coded channels. An audio decoder switches techniques for applying quantization matrices to multi-channel audio data depending on whether the channels are jointly coded.

The audio encoder compresses quantization matrices using direct compression or indirect, parametric compression. The indirect, parametric compression results in very low bitrate for the quantization matrices, but also reduces quality. Similarly, the decoder decompresses the quantization matrices using direct decompression or indirect, parametric decompression.

According to the illustrative embodiment, the audio encoder uses several techniques in the generation and compression of quantization matrices. The audio decoder uses several techniques in the decompression and application of quantization matrices. While the techniques are typically described herein as part of a single, integrated system, the techniques can be applied separately, potentially in combination with other techniques. In alternative embodiments, an audio processing tool other than an encoder or decoder implements one or more of the techniques.

I. Computing Environment

FIG. 2 illustrates a generalized example of a suitable computing environment (200) in which the illustrative embodiment may be implemented. The computing environment (200) is not intended to suggest any limitation as to scope of use or functionality of the invention, as the present invention may be implemented in diverse general-purpose or special-purpose computing environments.

With reference to FIG. 2, the computing environment (200) includes at least one processing unit (210) and memory (220). In FIG. 2, this most basic configuration (230) is included within a dashed line. The processing unit (210) executes computer-executable instructions and may be a real or a virtual processor. In a multi-processing system, multiple processing units execute computer-executable instructions to increase processing power. The memory (220) may be volatile memory (e.g., registers, cache, RAM), non-volatile memory (e.g., ROM, EEPROM, flash memory, etc.), or some combination of the two. The memory (220) stores software (280) implementing an audio encoder that generates and compresses quantization matrices.

A computing environment may have additional features. For example, the computing environment (200) includes storage (240), one or more input devices (250), one or more output devices (260), and one or more communication connections (270). An interconnection mechanism (not shown) such as a bus, controller, or network interconnects the components of the computing environment (200). Typically, operating system software (not shown) provides an operating environment for other software executing in the computing environment (200), and coordinates activities of the components of the computing environment (200).

The storage (240) may be removable or non-removable, and includes magnetic disks, magnetic tapes or cassettes, CD-ROMs, CD-RWs, DVDs, or any other medium which can be used to store information and which can be accessed within the computing environment (200). The storage (240) stores instructions for the software (280) implementing the audio encoder that that generates and compresses quantization matrices.

The input device(s) (250) may be a touch input device such as a keyboard, mouse, pen, or trackball, a voice input device, a scanning device, or another device that provides input to the computing environment (200). For audio, the input device(s) (250) may be a sound card or similar device that accepts audio input in analog or digital form, or a CD-ROM reader that provides audio samples to the computing environment. The output device(s) (260) may be a display, printer, speaker, CD-writer, or another device that provides output from the computing environment (200).

The communication connection(s) (270) enable communication over a communication medium to another computing entity. The communication medium conveys information such as computer-executable instructions, compressed audio or video information, or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

The invention can be described in the general context of computer-readable media. Computer-readable media are any available media that can be accessed within a computing environment. By way of example, and not limitation, with the computing environment (200), computer-readable media include memory (220), storage (240), communication media, and combinations of any of the above.

The invention can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing environment.

For the sake of presentation, the detailed description uses terms like "determine," "generate," "adjust," and "apply" to describe computer operations in a computing environment. These terms are high-level abstractions for operations performed by a computer, and should not be confused with acts performed by a human being. The actual computer operations corresponding to these terms vary depending on implementation.

II. Generalized Audio Encoder and Decoder

Figure 4:
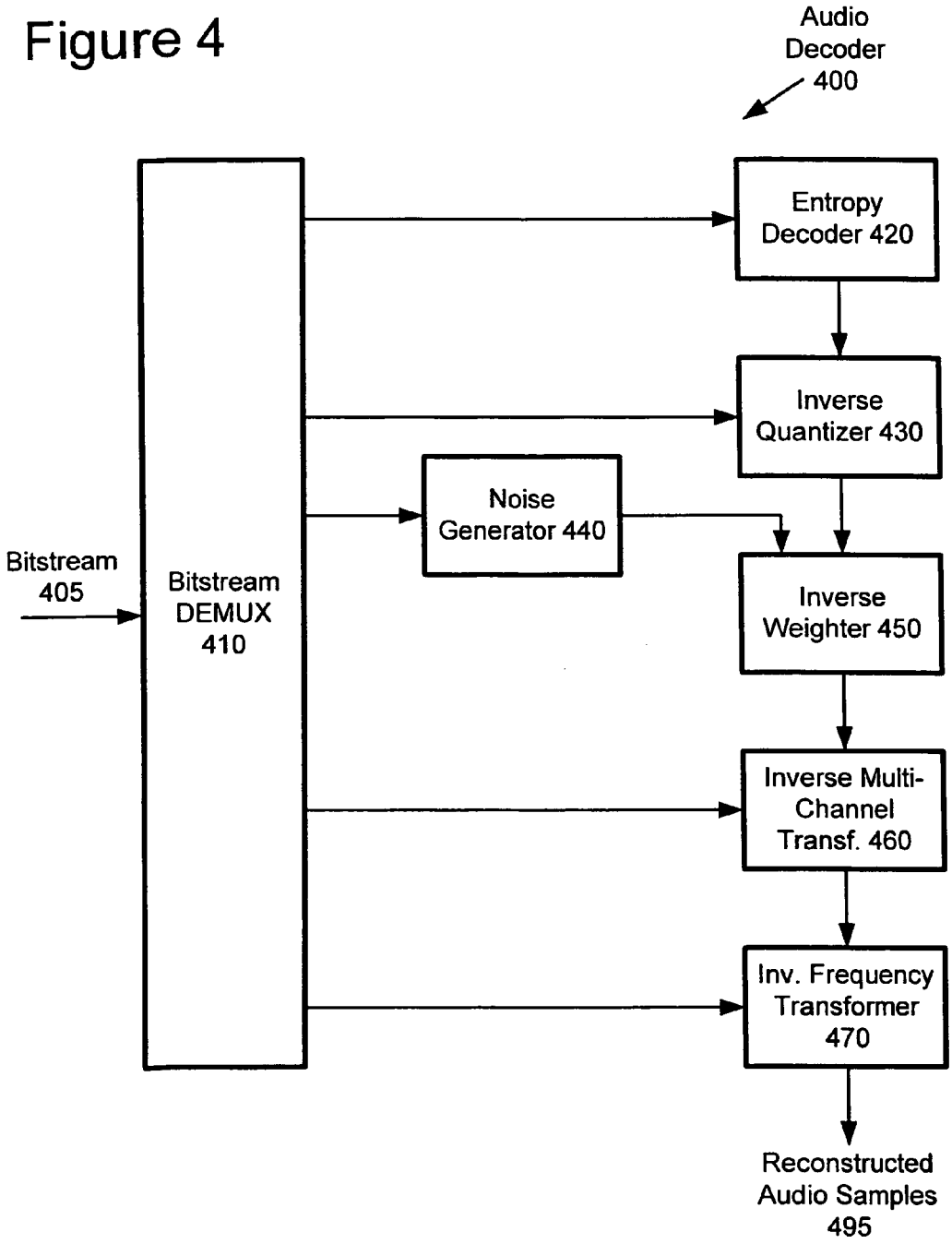
FIG. 4 is a block diagram of a generalized audio decoder according to the illustrative embodiment.

FIG. 3 is a block diagram of a generalized audio encoder (300). The encoder (300) generates and compresses quantization matrices. FIG. 4 is a block diagram of a generalized audio decoder (400). The decoder (400) decompresses and applies quantization matrices.

The relationships shown between modules within the encoder and decoder indicate the main flow of information in the encoder and decoder; other relationships are not shown for the sake of simplicity. Depending on implementation and the type of compression desired, modules of the encoder or decoder can be added, omitted, split into multiple modules, combined with other modules, and/or replaced with like modules. In alternative embodiments, encoders or decoders with different modules and/or other configurations of modules process quantization matrices.

A. Generalized Audio Encoder

The generalized audio encoder (300) includes a frequency transformer (310), a multi-channel transformer (320), a perception modeler (330), a weighter (340), a quantizer (350), an entropy encoder (360), a controller (370), and a bitstream multiplexer ["MUX"] (380).

The encoder (300) receives a time series of input audio samples (305) in a format such as one shown in Table 1. For input with multiple channels (e.g., stereo mode), the encoder (300) processes channels independently, and can work with jointly coded channels following the multi-channel transformer (320). The encoder (300) compresses the audio samples (305) and multiplexes information produced by the various modules of the encoder (300) to output a bitstream (395) in a format such as Windows Media Audio ["WMA"] or Advanced Streaming Format ["ASF"]. Alternatively, the encoder (300) works with other input and/or output formats.

The frequency transformer (310) receives the audio samples (305) and converts them into data in the frequency domain. The frequency transformer (310) splits the audio samples (305) into blocks, which can have variable size to allow variable temporal resolution. Small blocks allow for greater preservation of time detail at short but active transition segments in the input audio samples (305), but sacrifice some frequency resolution. In contrast, large blocks have better frequency resolution and worse time resolution, and usually allow for greater compression efficiency at longer and less active segments, in part because frame header and side information is proportionally less than in small blocks. Blocks can overlap to reduce perceptible discontinuities between blocks that could otherwise be introduced by later quantization. The frequency transformer (310) outputs blocks of frequency coefficient data to the multi-channel transformer (320) and outputs side information such as block sizes to the MUX (380). The frequency transformer (310) outputs both the frequency coefficients and the side information to the perception modeler (330).

In the illustrative embodiment, the frequency transformer (310) partitions a frame of audio input samples (305) into overlapping sub-frame blocks with time-varying size and applies a time-varying MLT to the sub-frame blocks. Possible sub-frame sizes include 256, 512, 1024, 2048, and 4096 samples. The MLT operates like a DCT modulated by a time window function, where the window function is time varying and depends on the sequence of sub-frame sizes. The MLT transforms a given overlapping block of samples $x[n], 0 \leqq n < subframe_size$ into a block of frequency coefficients $X[k], 0 \leqq k < subframe_size/2$. The frequency transformer (310) can also output estimates of the transient strengths of samples in the current and future frames to the controller (370). Alternative embodiments use other varieties of MLT. In still other alternative embodiments, the frequency transformer (310) applies a DCT, FFT, or other type of modulated or non-modulated, overlapped or non-overlapped frequency transform, or use subband or wavelet coding.

For multi-channel audio data, the multiple channels of frequency coefficient data produced by the frequency transformer (310) often correlate. To exploit this correlation, the multi-channel transformer (320) can convert the multiple original, independently coded channels into jointly coded channels. For example, if the input is stereo mode, the multi-channel transformer (320) can convert the left and right channels into sum and difference channels:

$$X_{Sum}[k] = \frac{X_{Left}[k] + X_{Right}[k]}{2}, \tag{4}$$

$$X_{Diff}[k] = \frac{X_{Left}[k] - X_{Right}[k]}{2}. \tag{5}$$

Or, the multi-channel transformer (320) can pass the left and right channels through as independently coded channels. More generally, for a number of input channels greater than one, the multi-channel transformer (320) passes original, independently coded channels through unchanged or converts the original channels into jointly coded channels. The decision to use independently or jointly coded channels can be predetermined, or the decision can be made adaptively on a block by block or other basis during encoding. The multi-channel transformer (320) produces side information to the MUX (380) indicating the channel mode used.

The perception modeler (330) models properties of the human auditory system to improve the quality of the reconstructed audio signal for a given bitrate. The perception modeler (330) computes the excitation pattern of a variable-size block of frequency coefficients. First, the perception modeler (330) normalizes the size and amplitude scale of the block. This enables subsequent temporal smearing and establishes a consistent scale for quality measures. Optionally, the perception modeler (330) attenuates the coefficients at certain frequencies to model the outer/middle ear transfer function. The perception modeler (330) computes the energy of the coefficients in the block and aggregates the energies by, for example, 25 critical bands. Alternatively, the perception modeler (330) uses another number of critical bands (e.g., 55 or 109). The frequency ranges for the critical bands are implementation-dependent, and numerous options are well known. For example, see ITU-R BS 1387, the MP3 standard, or references mentioned therein. The perception modeler (330) processes the band energies to account for simultaneous and temporal masking. The section entitled, "Computing Excitation Patterns" describes this process in more detail. In alternative embodiments, the perception modeler (330) processes the audio data according to a different auditory model, such as one described or mentioned in ITU-R BS 1387 or the MP3 standard.

The weighter (340) generates weighting factors for a quantization matrix based upon the excitation pattern received from the perception modeler (330) and applies the weighting factors to the data received from the multi-channel transformer (320). The weighting factors include a weight for each of multiple quantization bands in the audio data. The quantization bands can be the same or different in number or position from the critical bands used elsewhere in the encoder (300). The weighting factors indicate proportions at which noise is spread across the quantization bands, with the goal of minimizing the audibility of the noise by putting more noise in bands where it is less audible, and vice versa. The weighting factors can vary in amplitudes and number of quantization bands from block to block. In one implementation, the number of quantization bands varies according to block size; smaller blocks have fewer quantization bands than larger blocks. For example, blocks with 0.128 coefficients have 13 quantization bands, blocks with 256 coefficients have 15 quantization bands, up to 25 quantization bands for blocks with 2048 coefficients. In one implementation, the weighter (340) generates a set of weighting factors for each channel of multi-channel audio data in independently coded channels, or generates a single set of weighting factors for jointly coded channels. In alternative embodiments, the weighter (340) generates the weighting factors from information other than or in addition to excitation patterns. Instead of applying the weighting factors, the weighter (340) can pass the weighting factors to the quantizer (350) for application in the quantizer (350).

The weighter (340) outputs weighted blocks of coefficient data to the quantizer (350) and outputs side information such as the set of weighting factors to the MUX (380). The weighter (340) can also output the weighting factors to the controller (370) or other modules in the encoder (300). The set of weighting factors can be compressed for more efficient representation. If the weighting factors are lossy compressed, the reconstructed weighting factors are typically used to weight the blocks of coefficient data. If audio information in a band of a block is completely eliminated for some reason (e.g., noise substitution or band truncation), the encoder (300) may be able to further improve the compression of the quantization matrix for the block.

The quantizer (350) quantizes the output of the weighter (340), producing quantized coefficient data to the entropy encoder (360) and side information including quantization step size to the MUX (380). Quantization introduces irreversible loss of information, but also allows the encoder (300) to regulate the quality and bitrate of the output bitstream (395) in conjunction with the controller (370). In FIG. 3, the quantizer (350) is an adaptive, uniform, scalar quantizer. The quantizer (350) applies the same quantization step size to each frequency coefficient, but the quantization step size itself can change from one iteration of a quantization loop to the next to affect the bitrate of the entropy encoder (360) output. In alternative embodiments, the quantizer is a non-uniform quantizer, a vector quantizer, and/or a non-adaptive quantizer.

The entropy encoder (360) losslessly compresses quantized coefficient data received from the quantizer (350). For example, the entropy encoder (360) uses multi-level run length coding, variable-to-variable length coding, run length coding, Huffman coding, dictionary coding, arithmetic coding, LZ coding, a combination of the above, or some other entropy encoding technique. The entropy encoder (360) can compute the number of bits spent encoding audio information and pass this information to the rate/quality controller (370).

The controller (370) works with the quantizer (350) to regulate the bitrate and/or quality of the output of the encoder (300). The controller (370) receives information from other modules of the encoder (300). In one implementation, the controller (370) receives 1) transient strengths from the frequency transformer (310), 2) sampling rate, block size information, and the excitation pattern of original audio data from the perception modeler (330), 3) weighting factors from the weighter (340), 4) a block of quantized audio information in some form (e.g., quantized, reconstructed), 5) bit count information for the block; and 6) buffer status information from the MUX (380). The controller (370) can include an inverse quantizer, an inverse weighter, an inverse multi-channel transformer, and potentially other modules to reconstruct the audio data or compute information about the block.

The controller (370) processes the received information to determine a desired quantization step size given current conditions. The controller (370) outputs the quantization step size to the quantizer (350). In one implementation, the controller (370) measures the quality of a block of reconstructed audio data as quantized with the quantization step size. Using the measured quality as well as bitrate information, the controller (370) adjusts the quantization step size with the goal of satisfying bitrate and quality constraints, both instantaneous and long-term. In alternative embodiments, the controller (370) works with different or additional information, or applies different techniques to regulate quality and/or bitrate.

The encoder (300) can apply noise substitution, band truncation, and/or multi-channel rematrixing to a block of audio data. At low and mid-bitrates, the audio encoder (300) can use noise substitution to convey information in certain bands. In band truncation, if the measured quality for a block indicates poor quality, the encoder (300) can completely eliminate the coefficients in certain (usually higher frequency) bands to improve the overall quality in the remaining bands. In multi-channel rematrixing, for low bitrate, multi-channel audio data in jointly coded channels, the encoder (300) can suppress information in certain channels (e.g. the difference channel) to improve the quality of the remaining channel(s) (e.g., the sum channel).

The MUX (380) multiplexes the side information received from the other modules of the audio encoder (300) along with the entropy encoded data received from the entropy encoder (360). The MUX (380) outputs the information in WMA format or another format that an audio decoder recognizes.

The MUX (380) includes a virtual buffer that stores the bitstream (395) to be output by the encoder (300). The virtual buffer stores a pre-determined duration of audio information (e.g., 5 seconds for streaming audio) in order to smooth over short-term fluctuations in bitrate due to complexity changes in the audio. The virtual buffer then outputs data at a relatively constant bitrate. The current fullness of the buffer, the rate of change of fullness of the buffer, and other characteristics of the buffer can be used by the controller (370) to regulate quality and/or bitrate.

B. Generalized Audio Decoder

With reference to FIG. 4, the generalized audio decoder (400) includes a bitstream demultiplexer ["DEMUX"] (410), an entropy decoder (420), an inverse quantizer (430), a noise generator (440), an inverse weighter (450), an inverse multi-channel transformer (460), and an inverse frequency transformer (470). The decoder (400) is simpler than the encoder (300) because the decoder (400) does not include modules for rate/quality control.

The decoder (400) receives a bitstream (405) of compressed audio information in WMA format or another format. The bitstream (405) includes entropy encoded data as well as side information from which the decoder (400) reconstructs audio samples (495). For audio data with multiple channels, the decoder (400) processes each channel independently, and can work with jointly coded channels before the inverse multi-channel transformer (460).

The DEMUX (410) parses information in the bitstream (405) and sends information to the modules of the decoder (400). The DEMUX (410) includes one or more buffers to compensate for short-term variations in bitrate due to fluctuations in complexity of the audio, network jitter, and/or other factors.

The entropy decoder (420) losslessly decompresses entropy codes received from the DEMUX (410), producing quantized frequency coefficient data. The entropy decoder (420) typically applies the inverse of the entropy encoding technique used in the encoder.

The inverse quantizer (430) receives a quantization step size from the DEMUX (410) and receives quantized frequency coefficient data from the entropy decoder (420). The inverse quantizer (430) applies the quantization step size to the quantized frequency coefficient data to partially reconstruct the frequency coefficient data. In alternative embodiments, the inverse quantizer applies the inverse of some other quantization technique used in the encoder.

From the DEMUX (410), the noise generator (440) receives information indicating which bands in a block of data are noise substituted as well as any parameters for the form of the noise. The noise generator (440) generates the patterns for the indicated bands, and passes the information to the inverse weighter (450).

The inverse weighter (450) receives the weighting factors from the DEMUX (410), patterns for any noise-substituted bands from the noise generator (440), and the partially reconstructed frequency coefficient data from the inverse quantizer (430). As necessary, the inverse weighter (450) decompresses the weighting factors. The inverse weighter (450) applies the weighting factors to the partially reconstructed frequency coefficient data for bands that have not been noise substituted. The inverse weighter (450) then adds in the noise patterns received from the noise generator (440) for the noise-substituted bands.

The inverse multi-channel transformer (460) receives the reconstructed frequency coefficient data from the inverse weighter (450) and channel mode information from the DEMUX (410). If multi-channel data is in independently coded channels, the inverse multi-channel transformer (460) passes the channels through. If multi-channel data is in jointly coded channels, the inverse multi-channel transformer (460) converts the data into independently coded channels.

The inverse frequency transformer (470) receives the frequency coefficient data output by the multi-channel transformer (460) as well as side information such as block sizes from the DEMUX (410). The inverse frequency transformer (470) applies the inverse of the frequency transform used in the encoder and outputs blocks of reconstructed audio samples (495).

III. Generating Quantization Matrices

According to the illustrative embodiment, an audio encoder generates a quantization matrix that spreads distortion across the spectrum of audio data in defined proportions. The encoder attempts to minimize the audibility of the distortion by using an auditory model to define the proportions in view of psychoacoustic properties of human perception.

In general, a quantization matrix is a set of weighting factors for quantization bands. For example, a quantization matrix Q[c][d] for a block i includes a weighting factor for each quantization band d of a coding channel c. Within the block i in the coding channel c, each frequency coefficient Z[k] that falls within the quantization band d is quantized by the factor $\zeta_{i,c}\cdot Q[c][d]$. $\zeta_{i,c}$ is a constant factor (i.e., overall quantization step size) for the whole block i in the coding channel c chosen to satisfy rate and/or quality control criteria.

When determining the weighting factors for the quantization matrix Q[c][d], the encoder incorporates an auditory model, processing the frequency coefficients for the block i by critical bands. While the auditory model sets the critical bands, the encoder sets the quantization bands for efficient representation of the quantization matrix. This allows the encoder to reduce the bitrate associated with the quantization matrix for different block sizes, sampling rates, etc., at the cost of coarser control over the allocation of bits (by weighting) to different frequency ranges.

Figure 5:
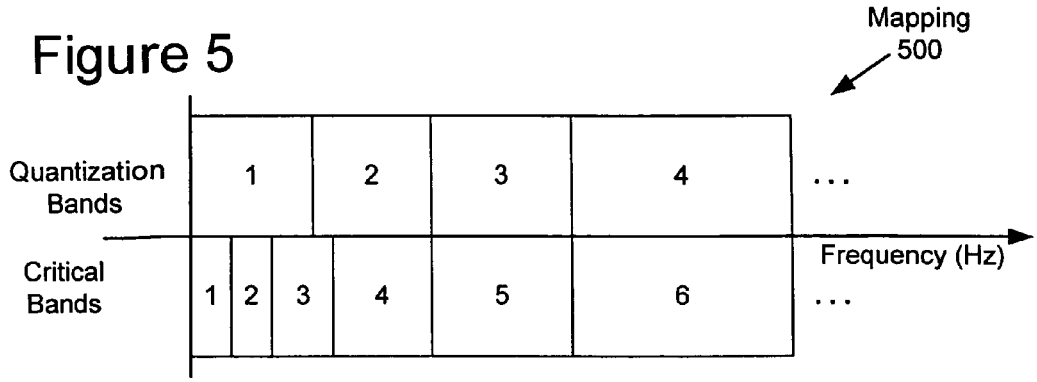
FIG. 5 is a chart showing a mapping of quantization bands to critical bands according to the illustrative embodiment.

The quantization bands for the quantization matrix need not map exactly to the critical bands. Instead, the number of quantization bands can be different (typically less) than the number of critical bands, and the band boundaries can be different as well. FIG. 5 shows an example of a mapping (500) between quantization bands and critical bands. To switch between quantization bands and critical bands, the encoder maps quantization bands to critical bands. The number and placement of quantization bands depends on implementation. In one implementation, the number of quantization bands relates to block size. For smaller blocks, the encoder maps multiple critical bands to a single quantization band, which leads to a decrease in the bitrate associated with the quantization matrix but also decreases the encoder's ability to allocate bits to distinct frequency ranges. For a block of 2048 frequency coefficients, the number of quantization bands is 25, and each quantization band maps to one of 25 critical bands of the same frequency range. For a block of the 64 frequency coefficients, the number of quantization bands is 13, and some quantization bands map to multiple critical bands.

Figure 6:
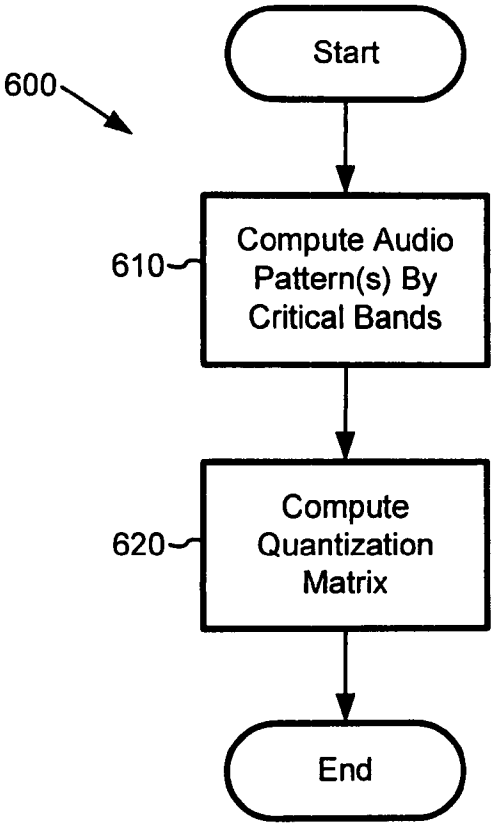
FIG. 6 is a flowchart showing a technique for generating a quantization matrix according to the illustrative embodiment.

The encoder uses a two-stage process to generate the quantization matrix: (1) compute a pattern for the audio waveform(s) to be compressed using the auditory model; and (2) compute the quantization matrix. FIG. 6 shows a technique (600) for generating a quantization matrix. The encoder computes (610) a critical band pattern for one or more blocks of spectral audio data. The encoder processes the critical band pattern according to an auditory model that accounts for the audibility of noise in the audio data. For example, the encoder computes the excitation pattern of one or more blocks of frequency coefficients. Alternatively, the encoder computes another type of critical band pattern, for example, a masking threshold or other pattern for critical bands described on mentioned in ITU-R BS 1387 or the MP3 standard.

The encoder then computes (620) a quantization matrix for the one or more blocks of spectral audio data. The quantization matrix indicates the distribution of distortion across the spectrum of the audio data.

Figure 7A:
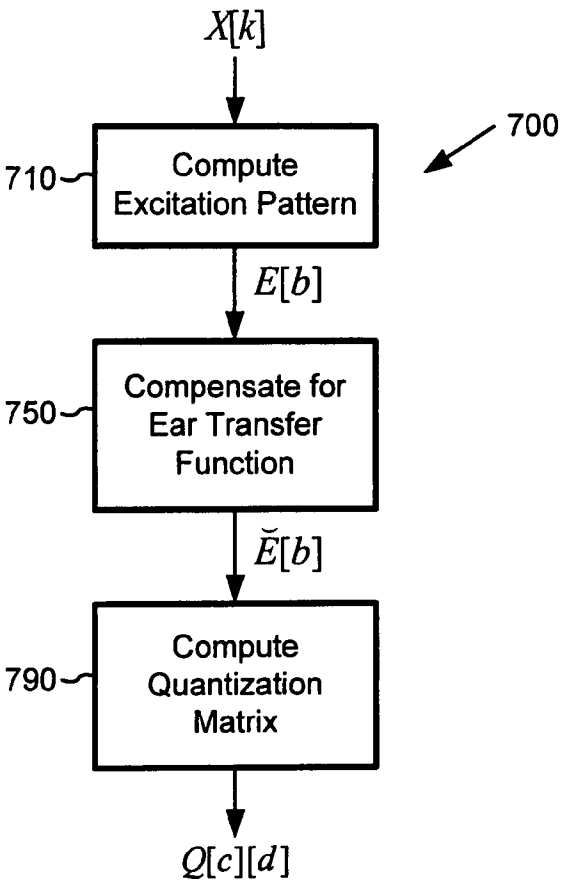
FIGS. 7*a*-7*c* are diagrams showing generation of a quantization matrix from an excitation pattern in an audio encoder according to the illustrative embodiment.
Figure 7C:
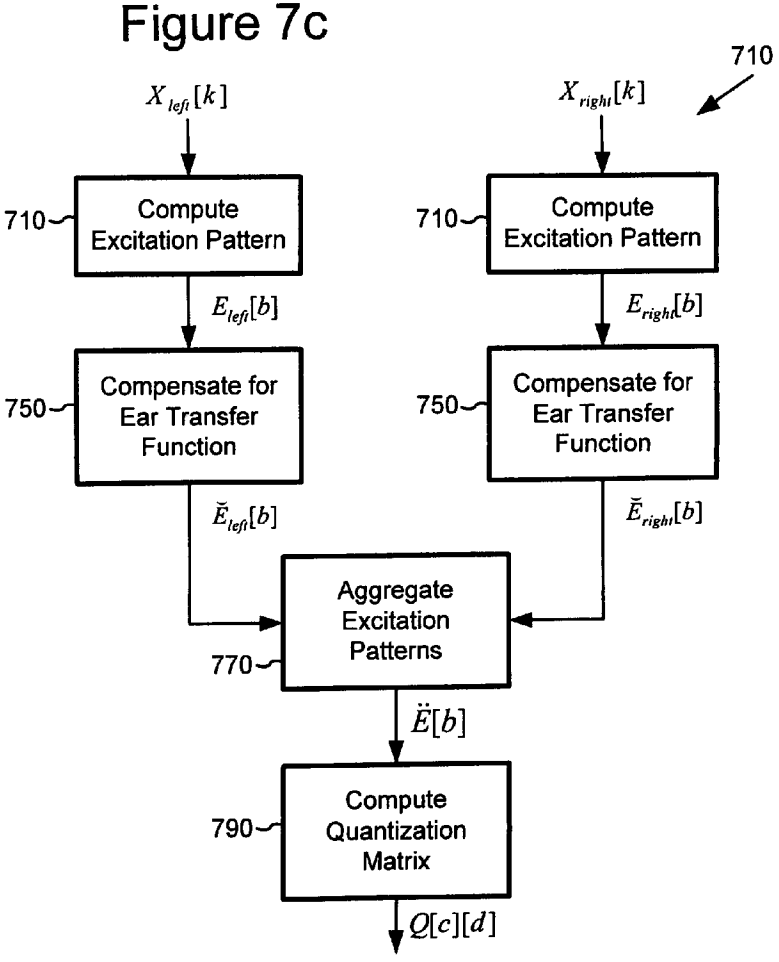
Figure 7B:
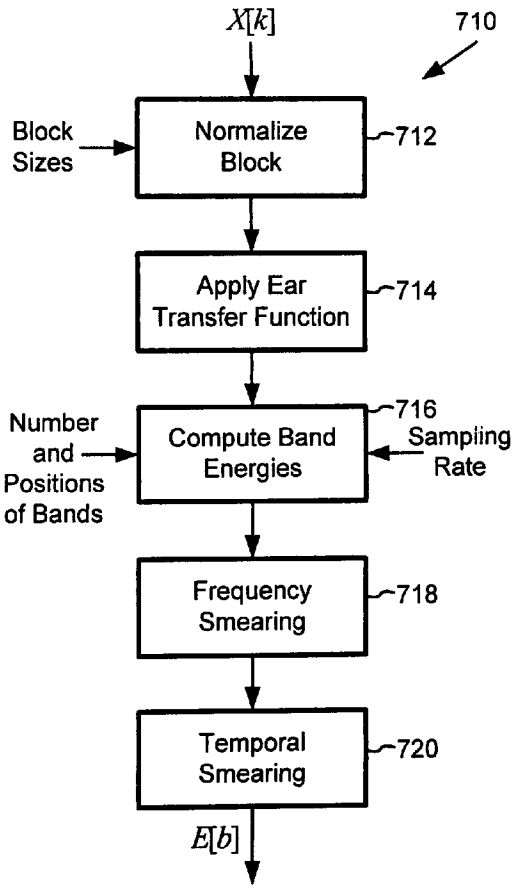

FIGS. 7*a*-7*c* show techniques for computing quantization matrices based upon excitation patterns for spectral audio data. FIG. 7*a* shows a technique (700) for generating a quantization matrix for a block of spectral audio data for an individual channel. FIG. 7*b* shows additional detail for one stage of the technique (700). FIG. 7*c* shows a technique (701) for generating a quantization matrix for corresponding blocks of spectral audio data in jointly coded channels of stereo mode audio data. The inputs to the techniques (700) and (701) include the original frequency coefficients X[k] for the block(s). FIG. 7*b* shows other inputs such as transform block size (i.e., current window/sub-frame size), maximum block size (i.e., largest time window/frame size), sampling rate, and the number and positions of critical bands.

A. Computing Excitation Patterns

With reference to FIG. 7*a*, the encoder computes (710) the excitation pattern E[b] for the original frequency coefficients X[k] of a block of spectral audio data in an individual channel. The encoder computes the excitation pattern E[b] with the same coefficients that are used in compression, using the sampling rate and block sizes used in compression.

FIG. 7*b* shows in greater detail the stage of computing (710) the excitation pattern E[b] for the original frequency coefficients X[k] in a variable-size transform block. First, the encoder normalizes (712) the block of frequency coefficients X[k], $0 \leqq k < (\text{subframe_size}/2)$ for a sub-frame, taking as inputs the current sub-frame size and the maximum sub-frame size (if not pre-determined in the encoder). The encoder normalizes the size of the block to a standard size by interpolating values between frequency coefficients up to the largest time window/sub-frame size. For example, the encoder uses a zero-order hold technique (i.e., coefficient repetition):

$$Y[k] = \alpha X[k'], \tag{6}$$

$$k' = \text{floor}\left(\frac{k}{\rho}\right), \tag{7}$$

$$\rho = \frac{\text{max_subframe_size}}{\text{subframe_size}}, \tag{8}$$

where Y[k] is the normalized block with interpolated frequency coefficient values, α is an amplitude scaling factor described below, and k' is an index in the block of frequency coefficients. The index k' depends on the interpolation factor ρ, which is the ratio of the largest sub-frame size to the current sub-frame size. If the current sub-frame size is 1024 coefficients and the maximum size is 4096 coefficients, ρ is 4, and for every coefficient from 0-511 in the current transform block (which has size of 0≦k<(subframe_size/2)), the normalized block Y[k] includes four consecutive values. Alternatively, the encoder uses other linear or non-linear interpolation techniques to normalize block size.

The scaling factor α compensates for changes in amplitude scale that relate to sub-frame size. In one implementation, the scaling factor is:

$$\alpha = \frac{c}{\text{subframe_size}}, \tag{9}$$

where c is a constant with a value determined experimentally in listening tests, for example, c=1.0. Alternatively, other scaling factors can be used to normalize block amplitude scale.

Returning to FIG. 7*b*, after normalizing (712) the block, the encoder applies (714) an outer/middle ear transfer function to the normalized block.

$$Y[k] \leftarrow A[k] \cdot Y[k] \tag{10}.$$

Figure 8:
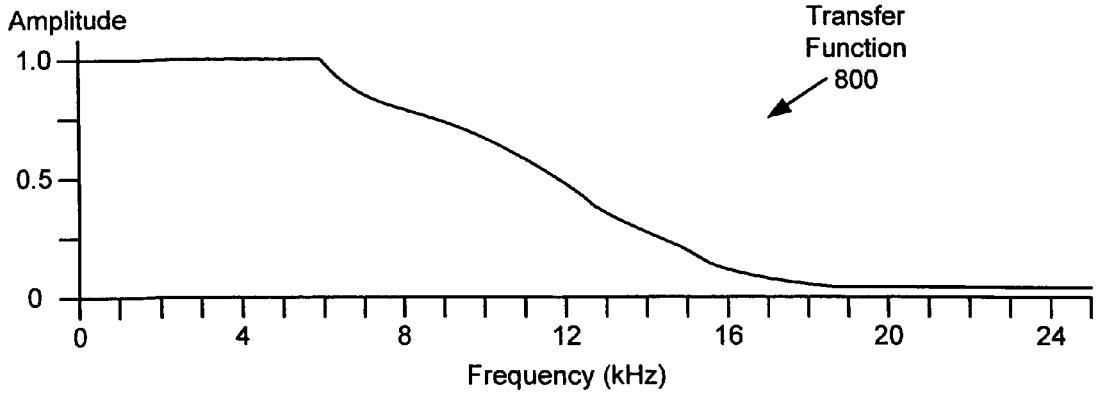
FIG. 8 is a graph of an outer/middle ear transfer function according to the illustrative embodiment.

Modeling the effects of the outer and middle ear on perception, the function A[k] generally preserves coefficients at lower and middle frequencies and attenuates coefficients at higher frequencies. FIG. 8 shows an example of a transfer function (800) used in one implementation. Alternatively, a transfer function of another shape is used. The application of the transfer function is optional. In particular, for high bitrate applications, the encoder preserves fidelity at higher frequencies by not applying the transfer function.

The encoder next computes (716) the band energies for the block, taking as inputs the normalized block of frequency coefficients Y[k], the number and positions of the bands, the maximum sub-frame size, and the sampling rate. (Alternatively, one or more of the band inputs, size, or sampling rate is predetermined.) Using the normalized block Y[k], the energy within each critical band b is accumulated:

$$E[b] = \sum_{k \in B[b]} Y^2[k], \tag{11}$$

where B[b] is a set of coefficient indices that represent frequencies within critical band b. For example, if the critical band b spans the frequency range $[f_l, f_h)$, the set B[b] can be given as:

$$B[b] = \left\{ k \;\middle|\; \begin{array}{l} k \cdot \dfrac{samplingrate}{\text{max_subframe_size}} \geq f_l \text{ AND} \\ k \cdot \dfrac{samplingrate}{\text{max_subframe_size}} < f_h \end{array} \right\}. \tag{12}$$

So, if the sampling rate is 44.1 kHz and the maximum sub-frame size is 4096 samples, the coefficient indices 38 through 47 (of 0 to 2047) fall within a critical band that runs from 400 up to but not including 510. The frequency ranges $[f_l, f_h)$ for the critical bands are implementation-dependent, and numerous options are well known. For example, see ITU-R BS 1387, the MP3 standard, or references mentioned therein.

Next, also in optional stages, the encoder smears the energies of the critical bands in frequency smearing (718) between critical bands in the block and temporal smearing (720) from block to block. The normalization of block sizes facilitates and simplifies temporal smearing between variable-size transform blocks. The frequency smearing (718) and temporal smearing (720) are also implementation-dependent, and numerous options are well known. For example, see ITU-R BS 1387, the MP3 standard, or references mentioned therein. The encoder outputs the excitation pattern E[b] for the block.

Alternatively, the encoder uses another technique to measure the excitation of the critical bands of the block.

B. Compensating for the Outer/Middle Ear Transfer Function

The outer/middle ear transfer function skews the excitation pattern by decreasing the contribution of high frequency coefficients. This numerical effect is desirable for certain operations involving the excitation pattern in the encoder (e.g., quality measurement). The numerical effect goes in the wrong direction, however, as to generation of quantization matrices in the illustrative embodiment, where the decreased contribution to excitation would lead to a smaller, rather than larger, weight.

With reference to FIG. 7*a*, the encoder compensates (750) for the outer/middle ear transfer function used in computing (710) the excitation pattern E[b], producing the modified excitation pattern Ĕ[b]:

$$\breve{E}[b] = \frac{E[b]}{\sum_{k \in B[b]} A^4[k]}. \tag{13}$$

The factor $A^4[k]$ neutralizes the factor $A^2[k]$ introduced in computing the excitation pattern and includes an additional factor $A^2[k]$, which skews the modified excitation pattern numerically to cause higher weighting factors for higher frequency bands. As a result, the distortion achieved through weighting by the quantization matrix has a similar spectral shape as that of the excitation pattern in the hypothetical inner ear. Alternatively, the encoder neutralizes the transfer function factor introduced in computing the excitation pattern, but does not include the additional factor.

If the encoder does not apply the outer/middle ear transfer function, the modified excitation pattern equals the excitation pattern:

$$\breve{E}[b] = E[b] \tag{14}.$$

C. Computing the Quantization Matrix

While the encoder computes (710) the excitation pattern on a block of a channel individually, the encoder quantizes frequency coefficients in independently or jointly coded channels. (The multi-channel transformer passes independently coded channels or converts them into jointly coded channels.) Depending on the coding channel mode, the encoder uses different techniques to compute quantization matrices.

1. Independently Coded Channels

With reference to FIG. 7*a*, the encoder computes (790) the quantization matrix for a block of an independently coded channel based upon the modified excitation pattern previously computed for that block and channel. So, each corresponding block of two independently coded channels has its own quantization matrix.

Since the critical bands of the modified excitation pattern can differ from the quantization bands of the quantization matrix, the encoder maps critical bands to quantization bands. For example, suppose the spectrum of a quantization band d overlaps (partially or completely) the spectrum of critical bands $b_{lowd}$ through $b_{highd}$. One formula for the weighting factor for the quantization band d is:

$$Q[c][d] = \sum_{b=b_{lowd}}^{b_{highd}} \breve{E}[b]. \tag{15}$$

Thus, the encoder gives equal weight to the modified excitation pattern values $\breve{E}[b_{lowd}]$ through $\breve{E}[b_{highd}]$ for the coding channel c to determine the weighting factor for the quantization band d. Alternatively, the encoder factors in the widths of the critical bands:

$$Q[c][d] = \frac{\sum_{b=b_{lowd}}^{b_{highd}} \breve{E}[b] \cdot Card\{B[b]\}}{\sum_{b=b_{lowd}}^{b_{highd}} Card\{B[b]\}}, \tag{16}$$

where B[b] is the set of coefficient indices that represent frequencies within the critical band b, and where Card{B[b]} is the number of frequency coefficients in B[b]. If critical bands do not align with quantization bands, in another alternative, the encoder can factor in the amount of overlap of the critical bands with the quantization band d:

$$Q[c][d] = \frac{\sum_{b=b_{lowd}}^{b_{highd}} \breve{E}[b] \cdot Card\{B[b] \cap B[d]\}}{Card\{B[d]\}}, \tag{17}$$

where B[d] is the set of coefficient indices that represent frequencies within quantization band d, and B[b]∩B[d] is the set of coefficient indices in both B[b] and B[d] (i.e., the intersection of the sets).

Critical bands can have different sizes, which can affect excitation pattern values. For example, the largest critical band can include several thousand frequency coefficients, while the smallest critical band includes about one hundred coefficients. Therefore, the weighting factors for larger quantization bands can be skewed relative to smaller quantization bands, and the encoder normalizes the quantization matrix by quantization band size:

$$Q[c][d] \leftarrow \left(\frac{Q[c][d]}{\text{Card}\{B[d]\}}\right)^{\mu} \tag{18}$$

where μ is an experimentally derived exponent (in listening tests) that affects relative weights of bands of different energies. In one implementation, μ is 0.25. Alternatively, the encoder normalizes the quantization matrix by band size in another manner.

Instead of the formulas presented above, the encoder can compute the weighting factor for a quantization band as the least excited overlapping critical band (i.e., minimum modified excitation pattern), most excited overlapping critical band (i.e., maximum modified excitation pattern), or other linear or non-linear function of the modified excitation patterns of the overlapping critical bands.

2. Jointly Coded Channels

Reconstruction of independently coded channels results in independently reconstructed channels. Quantization noise in one independently coded channel affects the reconstruction of that independently coded channel, but not other channels. In contrast, quantization noise in one jointly coded channel can affect all the reconstructed individual channels. For example, when a multi-channel transform is unitary (as in the sum-difference, pair-wise coding used for stereo mode audio data in the illustrative embodiment), the quantization noise of the jointly coded channels adds in the mean square error sense to form the overall quantization noise in the reconstructed channels. For sum and difference channels quantized with different quantization matrices, after the encoder transforms the channels into left and right channels, distortion in the left and right channels is dictated by the larger of the different quantization matrices.

So, for audio in jointly coded channels, the encoder directly controls distortion using a single quantization matrix rather than a different quantization matrix for each different channel. This can also reduce the resources spent generating quantization matrices. In some implementations, the encoder sends fewer quantization matrices in the output bitstream, and overall bitrate is lowered. Alternatively, the encoder calculates one quantization matrix but includes it twice in the output (e.g., if the output bitstream format requires two quantization matrices). In such a case, the second quantization matrix can be compressed to a zero differential from the first quantization matrix in some implementations.

With reference to FIG. 7*c*, the encoder computes (710) the excitation patterns for $X_{left}[k]$ and $X_{right}[k]$, even though the encoder quantizes $X_{sum}[k]$ and $X_{diff}[k]$ to compress the audio block. The encoder computes the excitation patterns $E_{left}[b]$ and $E_{right}[b]$ for the frequency coefficients $X_{left}[k]$ and $X_{right}[k]$ of blocks of frequency coefficients in left and right channels, respectively. For example, the encoder uses a technique such as one described above for E[b].

The encoder then compensates (750) for the effects of the outer/middle ear transfer function, if necessary, in each of the excitation patterns, resulting in modified excitation patterns $\breve{E}_{left}[b]$ and $\breve{E}_{right}[b]$. For example, the encoder uses a technique such as one described above for $\breve{E}[b]$.

Next, the encoder aggregates (770) the modified excitation patterns $\breve{E}_{left}[b]$ and $\breve{E}_{right}[b]$ to determine a representative modified excitation pattern $\ddot{E}_{left}[b]$:

$$\ddot{E}[b]=\text{Aggregate}\{\breve{E}[b], \text{ for channels } \{c_1, \ldots, c_N\}\} \tag{19},$$

where Aggregate{ } is a function for aggregating values across multiple channels $\{c_1, \ldots, c_N\}$. In one implementation, the Aggregate{ } function determines the mean value across the multiple channels. Alternatively, the Aggregate{ } function determines the sum, the minimum value, the maximum value, or some other measure.

The encoder then computes (790) the quantization matrix for the block of jointly coded channels based upon the representative modified excitation pattern. For example, the encoder uses a technique such as one described above for computing a quantization matrix from a modified excitation pattern Ě[b] for a block of an independently coded channel.

The Aggregate{ } function is typically simpler than the technique used to compute a quantization matrix from a modified excitation pattern. Thus, computing a single quantization matrix for multiple channels is usually more computationally efficient than computing different quantization matrices for the multiple channels.

Figure 9:
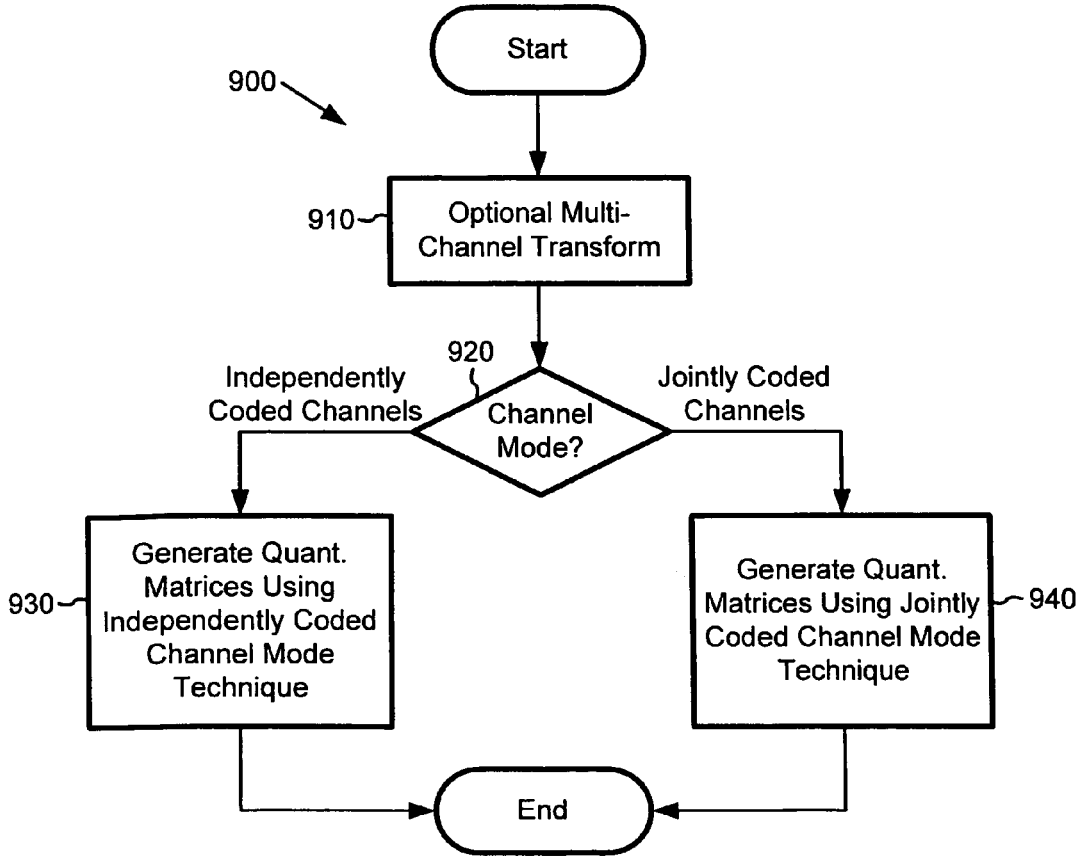
FIG. 9 is a flowchart showing a technique for generating quantization matrices in a coding channel mode-dependent manner according to the illustrative embodiment.

More generally, FIG. 9 shows a technique (900) for generating quantization matrices in a coding channel mode-dependent manner. An audio encoder optionally applies (910) a multi-channel transform to multi-channel audio data. For example, for stereo mode input, the encoder outputs the stereo data in independently coded channels or in jointly coded channels.

The encoder determines (920) the coding channel mode of the multi-channel audio data and then generates quantization matrices in a coding channel mode-dependent manner for blocks of audio data. The encoder can determine (920) the coding channel mode on a block by block basis, at another interval, or at marked switching points.

If the data is in independently coded channels, the encoder generates (930) quantization matrices using a technique for independently coded channels, and if the data is in jointly coded channels, the encoder generates (940) quantization matrices using a technique for jointly coded channels. For example, the encoder generates a different number of quantization matrices and/or generates the matrices from different combination of input depending on the coding channel mode.

While FIG. 9 shows two coding channel modes, other numbers of modes are possible. For the sake of simplicity, FIG. 9 does not show mapping of critical bands to quantization bands, or other ways in which the technique (900) can be used in conjunction with other techniques.

IV. Compressing Quantization Matrices

According to the illustrative embodiment, the audio encoder compresses quantization matrices to reduce the bitrate associated with the quantization matrices, using lossy and/or lossless compression. The encoder then outputs the compressed quantization matrices as side information in the bitstream of compressed audio information.

The encoder uses any of several available compression modes depending upon bitrate requirements, quality requirements, user input, or another selection criterion. For example, the encoder uses indirect, parametric compression of quantization matrices for low bitrate applications, and uses a form of direct compression for other applications.

The decoder typically reconstructs the quantization matrices by applying the inverse of the compression used in the encoder. The decoder can receive an indicator of the compression/decompression mode as additional side information. Alternatively, the compression/decompression mode can be pre-determined for a particular application or inferred from the decoding context.

A. Direct Compression/Decompression Mode

In a direct compression mode, the encoder quantizes and/or entropy encodes a quantization matrix. For example, the encoder uniformly quantizes, differentially codes, and then Huffman codes individual weighting factors of the quantization matrix, as shown in FIG. 1. Alternatively, the encoder uses other types of quantization and/or entropy encoding (e.g., vector quantization) to directly compress the quantization matrix. In general, direct compression results in higher quality and bitrate than other modes of compression. The level of quantization affects the quality and bitrate of the direct compression mode.

During decoding, the decoder reconstructs the quantization matrix by applying the inverse of the quantization and/or entropy encoding used in the encoder. For example, to reconstruct a quantization matrix compressed according to the technique (100) shown in FIG. 1, the decoder entropy decodes, inverse differentially codes, and inverse uniformly quantizes elements of the quantization matrix.

B. Parametric Compression/Decompression Mode

Figure 10A:
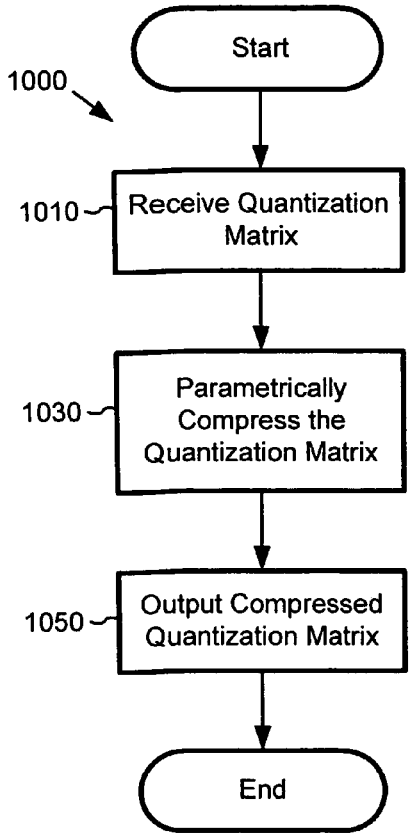
FIGS. 10*a*-10*b* are flowcharts showing techniques for parametric compression of a quantization matrix according to the illustrative embodiment.
Figure 10B:
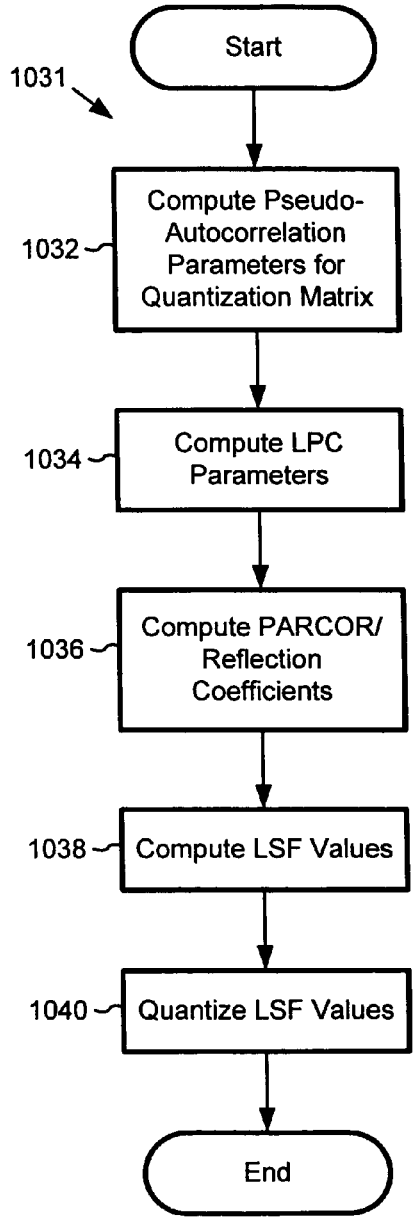
Figure 11A:
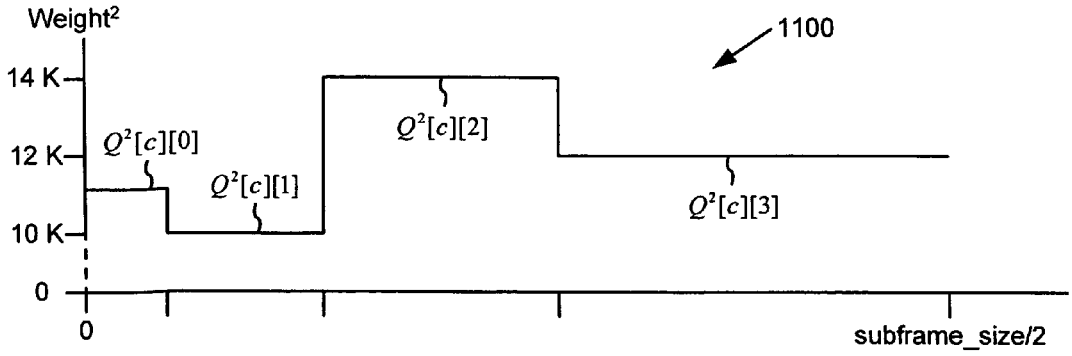
FIGS. 11*a*-11*b* are graphs showing an intermediate array used in the creation of pseudo-autocorrelation values from a quantization matrix according to the illustrative embodiment.
Figure 11B:
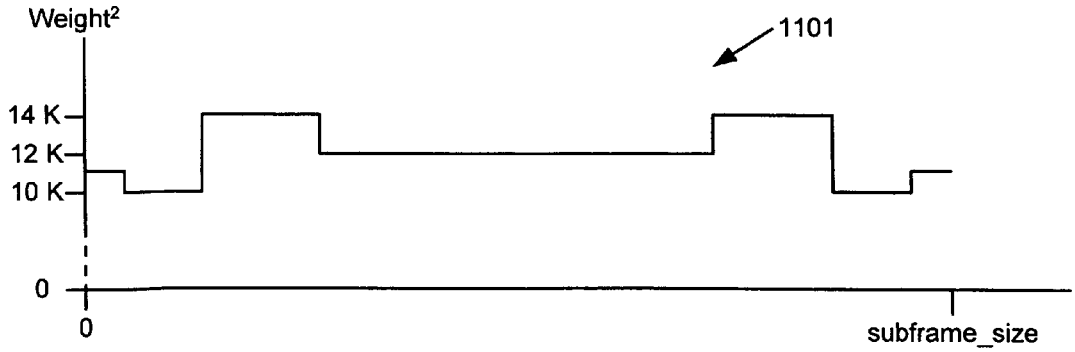

In a parametric compression mode, the encoder represents a quantization matrix as a set of parameters. The set of parameters indicates the basic form of the quantization matrix at a very low bitrate, which makes parametric compression suitable for very low bitrate applications. At the same time, the encoder incorporates an auditory model when computing quantization matrices, so a parametrically coded quantization matrix accounts for the audibility of noise, processing by critical bands, temporal and simultaneous spreading, etc FIG. 10*a* shows a technique (1000) for parametrically compressing a quantization matrix. FIG. 10*b* shows additional detail for a type of parametric compression that uses pseudo-autocorrelation parameters derived from the quantization matrix. FIGS. 11*a* and 11*b* show an intermediate array used in the creation of pseudo-autocorrelation parameters from a quantization matrix.

With reference to FIG. 10*a*, an audio encoder receives (1010) a quantization matrix in a channel-by-band format Q[c][d] for a block of frequency coefficients. Alternatively, the encoder receives a quantization matrix of another type or format, for example, an array of weighting factors.

The encoder parametrically compresses (1030) the quantization matrix. For example, the encoder uses the technique (1031) of FIG. 10*b* using Linear Predictive Coding ["LPC"] of pseudo-autocorrelation parameters computed from the quantization matrix. Alternatively, the encoder uses another parametric compression technique, for example, a covariance method or lattice method to determine LPC parameters, or another technique described or mentioned in A. M. Kondoz, *Digital Speech: Coding for Low Bit Rate Communications Systems*, "Chapter 3.3: Linear Predictive Modeling of Speech Signals" and "Chapter 4: LPC Parameter Quantisation Using LSFs," John Wiley & Sons (1994).

With reference to the technique (1031) of FIG. 10*b*, the encoder computes (1032) pseudo-autocorrelation parameters. For each quantization band d in a coding channel c, the encoder determines a weight $Q^{\beta}[c][d]$, where the exponent β is derived experimentally in listening tests. In one implementation, β is 2.0.

The encoder then replicates each weight in the matrix $Q^{\beta}[c][d]$ by an expansion factor to obtain an intermediate array. The expansion factor for a weight relates to the size of the quantization band d for the block associated with the quantization matrix. For example, for a quantization band of 8 frequency coefficients, the weight for the band is replicated 8 times in the intermediate array. After replication, the intermediate array represents a mask array with a value at each frequency coefficient for the block associated with the quantization matrix. FIG. 11*a* shows an intermediate array (1100) with replicated quantization band weights for a quantization matrix with four quantization bands and β of 2.0. The intermediate array (1100) shows replicated weights in the range of 10,000 to 14,000, which roughly correspond to weighting factors of of 100-120 before application of β.

The intermediate array (1100) has subframe_size/2 entries, which is the original transform block size for the block associated with the quantization matrix. FIG. 11*a* shows a simple intermediate array with four discrete stages, corresponding to the four quantization bands. For a quantization matrix with more quantization bands (e.g., 13, 15, 25), the intermediate array would have more stages.

The encoder next duplicates the intermediate array (1100) by appending its mirror image, as shown in FIG. 11*b*. The mirrored intermediate array (1101) has subframe_size entries. (The mirrored intermediate array (1101) can be in the same or a different data structure than the starting intermediate array (1100).) In practice, the encoder mirrors the intermediate array by duplicating the last value and not using the first value in the mirroring. For example, the array [0, 1, 2, 3] becomes [0, 1, 2, 3, 3, 3, 2, 1].

The encoder applies an inverse FFT to transform the mirrored intermediate array (1101) into an array of real numbers in the time domain. Alternatively, the encoder applies another inverse frequency transform to get a time series of values from the mirrored intermediate array (1101).

The encoder computes (1032) the pseudo-autocorrelation parameters as short-term correlations between the real numbers in the transformed array. The pseudo-autocorrelation parameters are different than autocorrelation parameters that could be computed from the original audio samples. The encoder incorporates an auditory model when computing quantization matrices, so the pseudo-autocorrelation parameters account for the audibility of noise, processing by critical bands, masking, temporal and simultaneous spreading, etc. In contrast, if the encoder computed a quantization matrix from autocorrelation parameters, the quantization matrix would reflect the spectrum of the original data. The pseudo-autocorrelation parameters can also account for joint coding of channels with a quantization matrix computed from an aggregate excitation pattern or for multiple jointly coded channels. Depending on implementation, the encoder may normalize the pseudo-autocorrelation parameters.

After the encoder computes the pseudo-autocorrelation parameters, the encoder computes (1134) LPC parameters from the pseudo-autocorrelation parameters using a technique such as Levinson recursion.

Next, the encoder converts the LPC parameters to Line Spectral Frequency ["LSF"] values. The encoder computes (1136) partial correlation ["PARCOR"] or reflection coefficients from the LPC parameters. The encoder computes (1138) the Line Spectral Frequency ["LSF"] values from the PARCOR coefficients using a method such as complex root, real root, ratio filter, Chebyshev, or adaptive sequential LMS. Finally, the encoder quantizes (1140) the LSF values. Alternatively, the encoder converts LPC parameters to a log area ratio, inverse sine, or other representation.

Returning to FIG. 10*a*, the encoder outputs (1050) the compressed quantization matrix. For example, the encoder sends the compressed quantization matrix as side information in the bitstream of compressed audio information.

An audio decoder reconstructs the quantization matrix from the set of parameters. The decoder receives the set of parameters in the bitstream of compressed audio information. The decoder applies the inverse of the parametric encoding used in the encoder. For example, to reconstruct a quantization matrix compressed according to the technique (1031) shown in FIG. 10*b*, the decoder inverse quantizes LSF values, computes PARCOR or reflection coefficients from the reconstructed LSF values, and computes LPC parameters from the PARCOR/reflection coefficients. The decoder inverse frequency transforms the LPC parameters to get a quantization matrix, for example, relating the LPC parameters ($a_j$'s) to frequency responses (A[z]):

$$A(z) = 1 - \sum_{j=1}^{p} a_j z^{-j}, \tag{20}$$

where p is the number of parameters. The decoder then applies the inverse of β to the weights to reconstruct weighting factors for the quantization matrix. The decoder then applies the reconstructed quantization matrix to reconstruct the audio information. The decoder need not compute pseudo-autocorrelation parameters from the LPC parameters to reconstruct the quantization matrix.

In an alternative embodiment, the encoder exploits characteristics of quantization matrices under the parametric model to simplify the generation and compression of quantization matrices.

Starting with a block of frequency coefficients, the encoder computes excitation patterns for the critical bands of the block. For example, for a block of eight coefficients [0 . . . 8] divided into two critical bands [0 . . . 2,3 . . . 7] the encoder computes the excitation pattern values a and b for the first and second critical bands, respectively.

For each critical band, the encoder replicates the excitation pattern value for the critical band by the number of coefficients in the critical band. Continuing the example started above, the encoder replicates the computed excitation pattern values and stores the values in an intermediate array [a,a,a,b,b,b,b,b]. The intermediate array has subframe_size/2 entries. From this point, the encoder processes the intermediate array like the encoder processes the intermediate array (1100) of FIG. 11 (appending its mirror image, applying an inverse FFT, etc.).

Having described and illustrated the principles of our invention with reference to an illustrative embodiment, it will be recognized that the illustrative embodiment can be modified in arrangement and detail without departing from such principles. It should be understood that the programs, processes, or methods described herein are not related or limited to any particular type of computing environment, unless indicated otherwise. Various types of general purpose or specialized computing environments may be used with or perform operations in accordance with the teachings described herein. Elements of the illustrative embodiment shown in software may be implemented in hardware and vice versa.

In view of the many possible embodiments to which the principles of our invention may be applied, we claim as our invention all such embodiments as may come within the scope and spirit of the following claims and equivalents thereto.

We claim:

1. A computer-readable storage medium having stored therein computer-executable instructions for causing a computer programmed thereby to perform a method of generating quantization matrices for plural blocks, wherein each of the plural blocks has one of plural available block sizes, the method comprising:

for each of the plural blocks having one of the plural available block sizes, normalizing the block;

computing pattern information using the normalized block in a block size-independent manner; and generating a quantization matrix based upon the pattern information.

2. The computer-readable storage medium of claim 1 wherein the plural blocks are frequency coefficient blocks, and wherein the computing includes processing the normalized frequency coefficient block according to an auditory model that includes temporal smearing between the normalized frequency coefficient block and an adjacent normalized frequency coefficient block.

3. The computer-readable storage medium of claim 1 wherein the normalizing comprises normalizing block size of the block.

4. The computer-readable storage medium of claim 3 wherein the normalizing block size uses a zero-order hold technique.

5. The computer-readable storage medium of claim 1 wherein the normalizing comprises normalizing amplitude scale of the block.

6. The computer-readable storage medium of claim 5 wherein the normalizing amplitude scale depends at least in part on an experimentally determined value.

7. The computer-readable storage medium of claim 1 wherein the plural blocks are frequency coefficient blocks for audio.

8. A method of generating quantization matrices for plural blocks, wherein each of the plural blocks has one of plural available block sizes, the method comprising:

for each of the plural blocks having one of the plural available block sizes, normalizing the block;

computing pattern information using the normalized block in a block size-independent manner;

generating a quantization matrix based upon the pattern information; and applying the quantization matrix to audio data;

compressing the quantization matrix; and outputting the compressed quantization matrix as part of a bitstream.

9. The method of claim 8 wherein the plural blocks are frequency coefficient blocks, and wherein the computing includes processing the normalized frequency coefficient block according to an auditory model that includes temporal smearing between the normalized frequency coefficient block and an adjacent normalized frequency coefficient block.

10. The method of claim 8 wherein the normalizing comprises normalizing block size of the block.

11. The method of claim 10 wherein the normalizing block size uses a zero-order hold technique.

12. The method of claim 8 wherein the normalizing comprises normalizing amplitude scale of the block.

13. The method of claim 12 wherein the normalizing amplitude scale depends at least in part on an experimentally determined value.

14. The method of claim 8 wherein the plural blocks are frequency coefficient blocks for audio.

15. A system for generating quantization matrices for plural blocks, wherein each of the plural blocks has one of plural available block sizes, the system comprising:

a perceptual modeler for normalizing each of the plural blocks having one of the plural available block sizes and for computing pattern information using the normalized block in a block size-independent manner;

a weighter for generating a quantization matrix based upon the pattern information; and a quantizer for applying the quantization matrix to audio data.

16. The system of claim 15 wherein the plural blocks normalized by the perceptual modeler are frequency coefficient blocks, and wherein the computing the pattern information includes processing the normalized frequency coefficient block according to an auditory model that includes temporal smearing between the normalized frequency coefficient block and an adjacent normalized frequency coefficient block.

17. The system of claim 15 wherein the normalizing comprises normalizing block size of the block.

18. The system of claim 17 wherein the normalizing block size uses a zero-order hold technique.

19. The system of claim 15 wherein the normalizing comprises normalizing amplitude scale of the block.

20. The system of claim 19 wherein the normalizing amplitude scale depends at least in part on an experimentally determined value.

* * * * *